US009522402B2

(12) United States Patent
Raksha et al.

(10) Patent No.: US 9,522,402 B2
(45) **Date of Patent: *Dec. 20, 2016**

(54) METHOD AND APPARATUS FOR ORIENTING MAGNETIC FLAKES

(71) Applicant: Viavi Solutions Inc., Milpitas, CA (US)

(72) Inventors: Vladimir P. Raksha, Santa Rosa, CA (US); Paul G. Coombs, Santa Rosa, CA (US); Charles T. Markantes, Santa Rosa, CA (US)

(73) Assignee: VIAVI SOLUTIONS INC., Milpitas, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/681,551

(22) Filed: Apr. 8, 2015

(65) Prior Publication Data

US 2015/0217307 A1 Aug. 6, 2015

Related U.S. Application Data

(60) Division of application No. 12/574,007, filed on Oct. 6, 2009, now Pat. No. 9,027,479, which is a (Continued)

(51) Int. Cl.
*B41F 11/02* (2006.01)
*B41M 3/14* (2006.01)

(Continued)

(52) U.S. Cl.
CPC ..... *B05B 5/00* (2013.01); *B05D 3/207* (2013.01); *B05D 5/06* (2013.01); *B05D 5/061* (2013.01);

(Continued)

(58) Field of Classification Search
CPC ..... B05D 3/207; B05D 5/06; B05D 5/061; B05D 3/20; B41F 11/02; B41M 3/00; B41M 5/00; B41M 7/045; B41M 7/0072; B41M 3/14; B42D 15/03; B42D 2035/20; B42D 2033/16; B41P 2200/30
See application file for complete search history.

(56) References Cited

U.S. PATENT DOCUMENTS 2,570,856 A 10/1951 Pratt et al.
3,011,383 A 12/1961 Sylvester et al.

(Continued)

FOREIGN PATENT DOCUMENTS

AU 488652 11/1977 ..... B44F 1/12
AU 488652 A1 11/1977

(Continued)

OTHER PUBLICATIONS

Argoitia et al, "Pigments Exhibiting Diffractive Effects", Soc. of Vac. Coaters, 45th Annual Tech. Conf. Proceed. (2002).

(Continued)

*Primary Examiner* — Jill Culler
*Assistant Examiner* — Leo T Hinze
(74) *Attorney, Agent, or Firm* — VLP Law Group LLP; Jeremy A. Cubert

(57) ABSTRACT

The invention relates to a method of aligning magnetic flakes, which includes: coating a substrate with a carrier having the flakes dispersed therein, moving the substrate in a magnetic field so as to align the flakes along force lines of the magnetic field in the absence of an effect from a solidifying means, and at least partially solidifying the carrier using a solidifying means while further moving the substrate in the magnetic field so as to secure the magnetic flakes in the carrier while the magnetic field maintains alignment of the magnetic flakes. An apparatus is provided, which has a belt for moving a substrate along a magnet assembly for aligning magnetic flakes. The apparatus also includes a solidifying means, such as a UV- or e-beam source, and a cover above a portion of the magnet assembly for protecting the flakes from the effect of the solidifying means.

12 Claims, 16 Drawing Sheets

Related U.S. Application Data continuation-in-part of application No. 11/623,190, filed on Jan. 15, 2007, now Pat. No. 7,934,451, and a continuation-in-part of application No. 11/552,219, filed on Oct. 24, 2006, now Pat. No. 7,876,481, and a continuation-in-part of application No. 11/278,600, filed on Apr. 4, 2006, now Pat. No. 8,343,615, and a continuation-in-part of application No. 11/313,165, filed on Dec. 20, 2005, now Pat. No. 7,604,855, which is a continuation-in-part of application No. 11/022,106, filed on Dec. 22, 2004, now Pat. No. 7,517,578, which is a continuation-in-part of application No. 10/386,894, filed on Mar. 11, 2003, now Pat. No. 7,047,883, said application No. 11/623,190 is a continuation-in-part of application No. 11/560,927, filed on Nov. 17, 2006, now Pat. No. 7,717,038, said application No. 12/574,007 is a continuation-in-part of application No. 11/313,165, filed on Dec. 20, 2005, now Pat. No. 7,604,855, which is a continuation-in-part of application No. 11/022,106, filed on Dec. 22, 2004, now Pat. No. 7,517,578, which is a continuation-in-part of application No. 10/386,894, filed on Mar. 11, 2003, now Pat. No. 7,047,883.

(60) Provisional application No. 60/759,356, filed on Jan. 17, 2006, provisional application No. 60/777,086, filed on Feb. 27, 2006, provisional application No. 60/668,852, filed on Apr. 6, 2005, provisional application No. 60/737,926, filed on Nov. 18, 2005, provisional application No. 60/410,546, filed on Sep. 13, 2002, provisional application No. 60/410,547, filed on Sep. 13, 2002, provisional application No. 60/396,210, filed on Jul. 15, 2002, provisional application No. 61/104,289, filed on Oct. 10, 2008.

(51) Int. Cl.

| | |
|---|---|
| ***B05B 5/00*** | (2006.01) |
| ***B05D 3/00*** | (2006.01) |
| ***B05D 5/06*** | (2006.01) |
| ***B41M 3/00*** | (2006.01) |
| ***B41M 5/00*** | (2006.01) |
| ***B42D 25/29*** | (2014.01) |
| ***B41F 23/00*** | (2006.01) |

(52) U.S. Cl.

CPC ..... *B41F 11/02* (2013.01); *B41F 23/00* (2013.01); *B41M 3/00* (2013.01); *B41M 3/14* (2013.01); *B41M 5/00* (2013.01); *B42D 25/29* (2014.10); *B41P 2200/30* (2013.01); *B42D 2033/16* (2013.01); *B42D 2035/20* (2013.01)

(56) References Cited

U.S. PATENT DOCUMENTS

| | | | |
|---|---|---|---|
| 3,123,490 | A | 3/1964 | Bolomey et al. |
| 3,293,331 | A | 12/1966 | Doherty |
| 3,338,730 | A | 8/1967 | Slade et al. |
| 3,610,721 | A | 10/1971 | Abramson et al. |
| 3,627,580 | A | 12/1971 | Krall |
| 3,633,720 | A | 1/1972 | Tyler |
| 3,676,273 | A | 7/1972 | Graves |
| 3,790,407 | A | 2/1974 | Merten et al. |
| 3,791,864 | A | 2/1974 | Steingroever |
| 3,845,499 | A | 10/1974 | Ballinger |
| 3,853,676 | A | 12/1974 | Graves |
| 3,873,975 | A | 3/1975 | Miklos et al. |
| 4,011,009 | A | 3/1977 | Lama et al. |
| 4,054,922 | A | 10/1977 | Fichter |
| 4,066,280 | A | 1/1978 | LaCapria |
| 4,099,838 | A | 7/1978 | Cook et al. |
| 4,126,373 | A | 11/1978 | Moraw |
| 4,155,627 | A | 5/1979 | Gale et al. |
| 4,168,983 | A | 9/1979 | Vittands et al. |
| 4,197,563 | A | 4/1980 | Michaud |
| 4,244,998 | A | 1/1981 | Smith |
| 4,271,782 | A | 6/1981 | Bate et al. |
| 4,310,584 | A | 1/1982 | Cooper et al. |
| 4,398,798 | A | 8/1983 | Krawczak et al. |
| 4,434,010 | A | 2/1984 | Ash |
| 4,543,551 | A | 9/1985 | Petersen |
| 4,657,349 | A | 4/1987 | Labes et al. |
| 4,705,300 | A | 11/1987 | Berning et al. |
| 4,705,356 | A | 11/1987 | Berning et al. |
| 4,721,217 | A | 1/1988 | Phillips et al. |
| 4,756,771 | A | 7/1988 | Brodalla et al. |
| 4,779,898 | A | 10/1988 | Berning et al. |
| 4,788,116 | A | 11/1988 | Hochberg |
| 4,838,648 | A | 6/1989 | Phillips et al. |
| 4,867,793 | A | 9/1989 | Franz et al. |
| 4,930,866 | A | 6/1990 | Berning et al. |
| 4,931,309 | A | 6/1990 | Komatsu et al. |
| 5,002,312 | A | 3/1991 | Phillips et al. |
| 5,009,486 | A | 4/1991 | Dobrowolski et al. |
| 5,059,245 | A | 10/1991 | Phillips et al. |
| 5,079,058 | A | 1/1992 | Tomiyama |
| 5,079,085 | A | 1/1992 | Hashimoto et al. |
| 5,084,351 | A | 1/1992 | Philips et al. |
| 5,106,125 | A | 4/1992 | Antes |
| 5,128,779 | A | 7/1992 | Mallik |
| 5,135,812 | A | 8/1992 | Phillips et al. |
| 5,142,383 | A | 8/1992 | Mallik |
| 5,171,363 | A | 12/1992 | Phillips et al. |
| 5,177,344 | A | 1/1993 | Pease |
| 5,186,787 | A | 2/1993 | Phillips et al. |
| 5,192,611 | A | 3/1993 | Tomiyama et al. |
| 5,214,530 | A | 5/1993 | Coombs et al. |
| 5,223,360 | A | 6/1993 | Prengel et al. |
| 5,254,390 | A | 10/1993 | Lu |
| 5,278,590 | A | 1/1994 | Phillips et al. |
| 5,279,657 | A | 1/1994 | Phillips et al. |
| 5,339,737 | A | 8/1994 | Lewis et al. |
| 5,364,467 | A | 11/1994 | Schmid et al. |
| 5,364,689 | A | 11/1994 | Kashiwagi et al. |
| 5,368,898 | A | 11/1994 | Akedo |
| 5,411,296 | A | 5/1995 | Mallik |
| 5,424,119 | A | 6/1995 | Phillips et al. |
| 5,437,931 | A | 8/1995 | Tsai et al. |
| 5,447,335 | A | 9/1995 | Haslop |
| 5,464,710 | A | 11/1995 | Yang |
| 5,474,814 | A | 12/1995 | Komatsu et al. |
| 5,549,774 | A | 8/1996 | Miekka et al. |
| 5,549,953 | A | 8/1996 | Li |
| 5,571,624 | A | 11/1996 | Phillips et al. |
| 5,591,527 | A | 1/1997 | Lu |
| 5,613,022 | A | 3/1997 | Odhner et al. |
| 5,624,076 | A | 4/1997 | Miekka et al. |
| RE35,512 | E | 5/1997 | Nowak et al. |
| 5,627,663 | A | 5/1997 | Horan et al. |
| 5,629,068 | A | 5/1997 | Miekka et al. |
| 5,630,877 | A | 5/1997 | Kashiwagi et al. |
| 5,643,686 | A | 7/1997 | Isshiki et al. |
| 5,648,165 | A | 7/1997 | Phillips et al. |
| 5,650,248 | A | 7/1997 | Miekka et al. |
| 5,672,410 | A | 9/1997 | Miekka et al. |
| 5,700,550 | A | 12/1997 | Uyama et al. |
| 5,742,411 | A | 4/1998 | Walters |
| 5,744,223 | A | 4/1998 | Abersfelder et al. |
| 5,763,086 | A | 6/1998 | Schmid et al. |
| 5,811,775 | A | 9/1998 | Lee |
| 5,815,292 | A | 9/1998 | Walters |
| 5,856,048 | A | 1/1999 | Tahara et al. |
| 5,858,078 | A | 1/1999 | Andes et al. |
| 5,907,436 | A | 5/1999 | Perry et al. |
| 5,912,767 | A | 6/1999 | Lee |
| 5,989,626 | A | 11/1999 | Coombs et al. |
| 5,991,078 | A | 11/1999 | Yoshitake et al. |
| 6,013,370 | A | 1/2000 | Coulter et al. |

(56) References Cited

U.S. PATENT DOCUMENTS

| | | | | |
|---|---|---|---|---|
| 6,031,457 | A | 2/2000 | Bonkowski et al. | |
| 6,033,782 | A | 3/2000 | Hubbard et al. | |
| 6,043,936 | A | 3/2000 | Large | |
| 6,045,230 | A | 4/2000 | Dreyer et al. | |
| 6,068,691 | A | 5/2000 | Miekka et al. | |
| 6,103,361 | A | 8/2000 | Batzar et al. | |
| 6,112,388 | A | 9/2000 | Kimoto et al. | |
| 6,114,018 | A | 9/2000 | Phillips et al. | |
| 6,150,022 | A | 11/2000 | Coulter et al. | |
| 6,157,489 | A | 12/2000 | Bradley, Jr. et al. | |
| 6,168,100 | B1 | 1/2001 | Kato et al. | |
| 6,241,858 | B1 | 6/2001 | Phillips et al. | |
| 6,242,510 | B1 | 6/2001 | Killey | |
| 6,243,204 | B1 | 6/2001 | Bradley, Jr. et al. | |
| 6,403,169 | B1 | 6/2002 | Hardwick et al. | |
| 6,549,131 | B1 | 4/2003 | Cote et al. | |
| 6,586,098 | B1 | 7/2003 | Coulter et al. | |
| 6,589,331 | B2 | 7/2003 | Ostertag et al. | |
| 6,643,001 | B1 | 11/2003 | Faris | |
| 6,649,256 | B1 | 11/2003 | Buczek et al. | |
| 6,686,027 | B1 | 2/2004 | Caporaletti et al. | |
| 6,692,031 | B2 | 2/2004 | McGrew | |
| 6,692,830 | B2 | 2/2004 | Argoitia et al. | |
| 6,712,399 | B1 | 3/2004 | Drinkwater et al. | |
| 6,749,777 | B2 | 6/2004 | Argoitia et al. | |
| 6,749,936 | B2 | 6/2004 | Argoitia et al. | |
| 6,751,022 | B2 | 6/2004 | Phillips | |
| 6,759,097 | B2 | 7/2004 | Phillips et al. | |
| 6,761,959 | B1 | 7/2004 | Bonkowski et al. | |
| 6,808,806 | B2 | 10/2004 | Phillips et al. | |
| 6,815,065 | B2 | 11/2004 | Argoitia et al. | |
| 6,818,299 | B2 | 11/2004 | Phillips et al. | |
| 6,838,166 | B2 | 1/2005 | Phillips et al. | |
| 6,841,238 | B2 | 1/2005 | Argoitia et al. | |
| 6,902,807 | B1 | 6/2005 | Argoitia et al. | |
| 6,903,850 | B2 | 6/2005 | Kay et al. | |
| 6,987,590 | B2 | 1/2006 | Phillips et al. | |
| 7,005,178 | B2 | 2/2006 | Bonkowski et al. | |
| 7,029,525 | B1 | 4/2006 | Mehta | |
| 7,029,745 | B2 | 4/2006 | Bonkowski et al. | |
| 7,047,883 | B2 | 5/2006 | Raksha et al. | |
| 7,054,042 | B2 | 5/2006 | Holmes et al. | |
| 7,169,472 | B2 | 1/2007 | Raksha et al. | |
| 7,224,528 | B2 | 5/2007 | Phillips et al. | |
| 7,229,520 | B2 | 6/2007 | Huang et al. | |
| 7,241,489 | B2 | 7/2007 | Argoitia et al. | |
| 7,258,900 | B2 | 8/2007 | Raksha et al. | |
| 7,258,915 | B2 | 8/2007 | Argoitia et al. | |
| 7,300,695 | B2 | 11/2007 | Argoitia et al. | |
| 2002/0182383 | A1 | 12/2002 | Phillips et al. | |
| 2003/0058491 | A1 | 3/2003 | Holmes et al. | |
| 2003/0087070 | A1 | 5/2003 | Souparis | |
| 2003/0165637 | A1 | 9/2003 | Phillips et al. | |
| 2003/0190473 | A1 | 10/2003 | Argoitia et al. | |
| 2004/0001973 | A1* | 1/2004 | Gao | C08K 3/08 428/692.1 |
| 2004/0009309 | A1 | 1/2004 | Raksha et al. | |
| 2004/0028905 | A1 | 2/2004 | Phillips et al. | |
| 2004/0051297 | A1 | 3/2004 | Raksha et al. | |
| 2004/0052976 | A1 | 3/2004 | Buczek et al. | |
| 2004/0081807 | A1 | 4/2004 | Bonkowski et al. | |
| 2004/0094850 | A1 | 5/2004 | Bonkowski et al. | |
| 2004/0100707 | A1 | 5/2004 | Kay et al. | |
| 2004/0101676 | A1 | 5/2004 | Phillips et al. | |
| 2004/0105963 | A1 | 6/2004 | Bonkowski et al. | |
| 2004/0151827 | A1 | 8/2004 | Argoitia et al. | |
| 2004/0166308 | A1 | 8/2004 | Raksha et al. | |
| 2005/0037192 | A1 | 2/2005 | Argoitia et al. | |
| 2005/0063067 | A1 | 3/2005 | Phillips et al. | |
| 2005/0106367 | A1 | 5/2005 | Raksha et al. | |
| 2005/0123755 | A1 | 6/2005 | Argoitia et al. | |
| 2005/0128543 | A1 | 6/2005 | Phillips et al. | |
| 2005/0189060 | A1 | 9/2005 | Huang et al. | |
| 2006/0035080 | A1 | 2/2006 | Argoitia | |
| 2006/0077496 | A1 | 4/2006 | Argoitia | |
| 2006/0097515 | A1 | 5/2006 | Raksha et al. | |
| 2006/0194040 | A1 | 8/2006 | Raksha et al. | |
| 2006/0198998 | A1 | 9/2006 | Raksha et al. | |
| 2006/0263539 | A1 | 11/2006 | Argoitia | |
| 2007/0058227 | A1 | 3/2007 | Raksha et al. | |
| 2008/0069979 | A1 | 3/2008 | Raksha et al. | |

FOREIGN PATENT DOCUMENTS

| | | | | |
|---|---|---|---|---|
| DE | 1696245 | | 1/1972 | D21H 5/10 |
| DE | 1696245 | A1 | 1/1972 | |
| DE | 3932505 | | 4/1991 | B44F 1/12 |
| DE | 3932505 | A1 | 4/1991 | |
| DE | 4212290 | | 5/1993 | |
| DE | 4212290 | C1 | 5/1993 | |
| DE | 4343387 | | 6/1995 | B44F 1/12 |
| DE | 4343387 | A1 | 6/1995 | |
| DE | 19611383 | | 9/1997 | B44F 1/12 |
| DE | 19611383 | A1 | 9/1997 | |
| DE | 19731968 | | 1/1999 | B44F 1/12 |
| DE | 19731968 | A1 | 1/1999 | |
| DE | 19744953 | | 4/1999 | B44F 1/12 |
| DE | 19744953 | A1 | 4/1999 | |
| DE | 19639165 | | 10/2003 | C09B 67/02 |
| DE | 19639165 | C2 | 10/2003 | |
| EP | 0138194 | | 10/1984 | B32B 27/08 |
| EP | 0138194 | A2 | 4/1985 | |
| EP | 0185396 | | 12/1985 | D21H 5/10 |
| EP | 0185396 | A2 | 6/1986 | |
| EP | 0341002 | | 11/1989 | G02B 5/28 |
| EP | 0341002 | A2 | 11/1989 | |
| EP | 0420261 | | 4/1991 | G06K 19/00 |
| EP | 0420261 | A2 | 4/1991 | |
| EP | 0453131 | | 10/1991 | |
| EP | 0453131 | A2 | 10/1991 | |
| EP | 0556449 | | 8/1993 | B05D 3/14 |
| EP | 0556449 | A1 | 8/1993 | |
| EP | 0406667 | | 1/1995 | B44C 1/00 |
| EP | 0406667 | B1 | 1/1995 | |
| EP | 0660262 | | 1/1995 | G06K 19/16 |
| EP | 0170439 | | 4/1995 | G02B 5/20 |
| EP | 0170439 | B2 | 4/1995 | |
| EP | 0660262 | A2 | 6/1995 | |
| EP | 0710508 | | 5/1996 | B05D 3/14 |
| EP | 0710508 | A1 | 5/1996 | |
| EP | 0756945 | | 2/1997 | B42D 15/00 |
| EP | 0756945 | A1 | 2/1997 | |
| EP | 0395410 | | 8/1997 | G02B 5/20 |
| EP | 0395410 | B1 | 8/1997 | |
| EP | 0698256 | | 10/1997 | G06K 19/14 |
| EP | 0698256 | B1 | 10/1997 | |
| EP | 0741370 | | 5/1998 | G06K 19/18 |
| EP | 0741370 | B1 | 8/1998 | |
| EP | 0914261 | | 5/1999 | B42D 15/10 |
| EP | 0914261 | A1 | 5/1999 | |
| EP | 0953937 | | 11/1999 | G06K 19/08 |
| EP | 0953937 | A1 | 11/1999 | |
| EP | 0978373 | | 2/2000 | B32B 7/02 |
| EP | 0978373 | A2 | 2/2000 | |
| EP | 1174278 | | 1/2002 | |
| EP | 1174278 | A1 | 1/2002 | |
| EP | 1239307 | | 9/2002 | G02B 5/22 |
| EP | 1239307 | A1 | 9/2002 | |
| EP | 1 353 197 | | 10/2003 | G02B 5/18 |
| EP | 1353197 | A2 | 10/2003 | |
| EP | 1 498 545 | | 1/2005 | D21H 21/42 |
| EP | 1493590 | | 1/2005 | B41M 21/42 |
| EP | 1493590 | A1 | 1/2005 | |
| EP | 1498545 | A1 | 1/2005 | |
| EP | 1516957 | | 3/2005 | |
| EP | 1516957 | A1 | 3/2005 | |
| EP | 1529653 | | 5/2005 | |
| EP | 1529653 | A1 | 5/2005 | |
| EP | 1719636 | | 11/2006 | B42D 15/10 |
| EP | 1719636 | A1 | 11/2006 | |
| EP | 1741757 | | 1/2007 | C09C 1/00 |
| EP | 1741757 | A1 | 1/2007 | |
| GB | 1107395 | | 3/1968 | G03G 1/00 |
| GB | 1107395 | A | 3/1968 | |

(56) References Cited

FOREIGN PATENT DOCUMENTS

| | | | | |
|---|---|---|---|---|
| GB | 1131038 | | 10/1968 | ..... B44F 3/00 |
| GB | 1131038 | A | 10/1968 | |
| JP | 63172779 | | 7/1988 | |
| JP | 11010771 | | 1/1999 | |
| WO | 88/07214 | | 9/1988 | ..... G02B 5/128 |
| WO | 88/07214 | A1 | 9/1988 | |
| WO | 93/23251 | | 11/1993 | ..... B41M 3/14 |
| WO | 93/23251 | A1 | 11/1993 | |
| WO | 95/17475 | | 1/1995 | ..... C09C 1/00 |
| WO | 95/13569 | | 5/1995 | ..... G03K 7/00 |
| WO | 95/13569 | A1 | 5/1995 | |
| WO | 95/17475 | A1 | 6/1995 | |
| WO | 97/19820 | | 6/1997 | ..... B42D 15/10 |
| WO | 97/19820 | A1 | 6/1997 | |
| WO | 98/12583 | | 3/1998 | ..... G02B 5/28 |
| WO | 98/12583 | A1 | 3/1998 | |
| WO | 00/08596 | | 2/2000 | ..... G06K 19/06 |
| WO | 00/08596 | A1 | 2/2000 | |
| WO | 01/03945 | | 1/2001 | ..... B42D 15/10 |
| WO | 01/03945 | A1 | 1/2001 | |
| WO | 02/53677 | | 1/2001 | ..... B42D 15/10 |
| WO | 01/53113 | | 7/2001 | ..... B42D 15/10 |
| WO | 01/53113 | A1 | 7/2001 | |
| WO | 02/00446 | | 1/2002 | ..... B42D 15/10 |
| WO | 02/00446 | A1 | 1/2002 | |
| WO | 02/04234 | | 1/2002 | |
| WO | 02/40599 | | 5/2002 | |
| WO | 02/40600 | | 5/2002 | |
| WO | 02/53677 | | 7/2002 | |
| WO | 02/090002 | | 11/2002 | |
| WO | 03/011980 | | 2/2003 | |
| WO | 03/102084 | | 12/2003 | |
| WO | 2004/007095 | | 1/2004 | |
| WO | 2004/007096 | | 1/2004 | |
| WO | 2004/024836 | | 3/2004 | |
| WO | 2005/017048 | | 2/2005 | ..... C09C 1/00 |
| WO | 2005/017048 | | 3/2005 | |
| WO | 2005/026848 | | 3/2005 | |
| WO | 2006/114289 | | 11/2006 | |

OTHER PUBLICATIONS

Argoitia et al. "The concept of printable holograms through the alignment of diffractive pigments" Electronic Imaging Science and Technology Proceedings, SPIE vol. 5310, Jan. 2004.

Alberto Argoitia, "Pigments Exhibiting a Combination of Thin Film and Diffractive Light Interference", AIMCAL Fall Technical Conference, 16th International Vacuum Web Coating Conference, Jan. 2002, pp. 1-9.

Coombs et al, "Integration of contracting technologies into advanced optical security devices", SPIE Conference on Document Security, Jan. 2004.

Roger W. Phillips, "Optically Variable Films, Pigments, and Inks" SPIE vol. 1323 Optical Thin Films III: New Developments, 1990, pp. 98-109.

Roger W. Phillips et al. "Optical Coatings for Document Security" Applied Optics, vol. 35, No. 28, Oct. 1, 1996 pp. 5529-5534.

Phillips et al., "Security Enhancement of Holograms with Interference Coatings" Optical Security and Counterfeit Deterrence Techniques III Proceedings of SPIE vol. 3973 p. 304-316 (2000).

I.M. Boswarva et al., "Roll Coater System for the Production of Optically Variable Devices (OVD's) for Security Applications" Proceedings, 33rd Annual technical Conference, Society of Vacuum Coaters, pp. 103-109 (1990).

J.A. Dobrowolski "Optical Thin-Film Security Devices", , Optical Security Document, Rudolf Van Renesse, Artech House, 1998, pp. 289-328.

J.A. Dobrowolski et al, "Optical Interference Coatings for Inhibiting of Counterfeiting" Optica Acta, 1973, vol. 20, No. 12, 925-037.

Dobrowolski et al, "Research on Thin Film Anticounterfeiting Coatings at the National Research Council of Canada", Applied Optics, vol. 28, No. 14, pp. 2701-2717 (Jul. 15, 1989).

Frans Defilet, LGZ Landis & Gyr Zug Corporation, "Kinegrams 'Optical Variable Devices' (OVD's) for Banknotes, Security Documents and Plastic Cards" San Diego, Apr. 1-3, 1987.

R. Domnick et al, "Influence of Nanosized Metal Clusters on the Generation of Strong Colors and Controlling of their Properties through Physical Vapor Deposition (PVD)" 49th Annual Technical Conference Proceedings (2006), Society of vacuum Coasters.

M. T. Gale, Paul Scherrer Diffractive Microstructures for Security Applications: Institute, Zurich, IEEE Conference Publication London 1991, pp. 205-209, Sep. 16-18, 1991.

Halliday et al, "Fundamental of Physics, Sixth Edition", p. 662, Jul. 2000.

Hardin, "Optical tricks designed to foil counterfeiters" OE Reports, No. 191, Nov. 1999.

Himpsel et al, "Nanowires by Step Decoration", Mat. Research Soc. Bul., p. 20-24 (Aug. 1999).

Lotz et al., "Optical Layers on Large Area Plastic Films" Precision, Applied Films (Nov. 2001).

S.P. McGrew, "Hologram Counterfeiting: Problems and Solutions" SPIE, vol. 1210 Optical Security and Anticounterfeiting Systems, 1990, pp. 66-76.

Steve McGrew, "Countermeasures Against Hologram Counterfeiting" Internet site www.iea.com/nli/publications/countermeasures.htm, Jan. 6, 2000.

John M. McKiernan et al; "Luminescence and Laser Action of Coumarin Dyes Doped in Silicate and Aluminosilicate Glasses Prepared by Sol-Gel Technique," Journal of Inorganic and Organometallic Polymers, vol. 1, No. 1, 1991, pp. 87-103.

Powell et al (Ed) "Vapor Deposition" John Wiley & Sons, p. 132 (1996).

Prokes and Wang (Ed)., "Novel Methods of Nanoscale Wire Formation", Mat. Reseach Soc. Bul. pp. 13-14 (Aug. 1999).

J. Rolfe "Optically Variable Devices for use on Bank Notes" SPIE, vol. 1210 Optical Security and Anticounterfeiting Systems, pp. 14-19, 1990.

Rudolf L. van Renesse, "Security Design of Valuable Documents and Products" SPIE, vol. 2659, Jun. 1996, pp. 10-20.

Rudolf L. van Renesse "Paper Based Document Security—a Review", European Conference on Security and Detection, Apr. 28-30, 1997, Conference Publication No. 437, p. 75-80.

Van Renesse (Ed) "Optical Document Security" 2nd Ed., Artech House, 254, 349-69 (1997).

Don W. Tomkins, Kurz Hastings, "Transparent Overlays for Security Printing and Plastic ID Cards" pp. 1-8, Nov. 1997.

Jeffrey I. Zink et al, "Optical Probes and Properties of Aluminosilicate Glasses Prepared by the Sol-Gel Method," Polym. Mater. Sci. Eng., pp. 204-208 (1989).

OVD Kinegram Cor "OVD Kinegram Management of Light to Provide Security" Internet site www.kiknegram.com.xhome.html, Dec. 17, 1999.

The Mearl Corporation Brochure for "Mearl Iridescent Film" Peekskill, NY, 1986.

The R.D. Mathis Company Manual for "Thin Film Evaporation Source Reference" Long Beach, CA, Oct. 2001.

European Search Repot for EP Application No. 09177912, Jan. 19, 2010.

Argoitia et al., "Pigments Exhibiting Diffractive Effects", Soc. of Vac. Coaters, 45th Annual Tech. Conf. Proceed. (2002).

Argoitia et al., "The concept of printable holograms through the alignment of diffractive pigments", Electronic Imaging Science and Technology Proceedings, SPIE vol. 5310, Jan. 2004.

Argoitia, "Pigments Exhibiting a Combination of Thin Film and Diffractive Light Interference", AIMCAL Fall Technical Conference, 16th International Vacuum Web Coating Conference, Jan. 2002, pp. 1-9.

Coombs et al., "Integration of contracting technologies into advanced optical security devices", SPIE Conference on Document Security, Jan. 2004.

Roger W. Phillips, "Optically Variable Films, Pigments, and Inks", SPIE vol. 1323 Optical Thin Films III: New Developments, 1990, pp. 98-109.

Phillips et al., "Optical Coatings for Document Security", Applied Optics, vol. 35, No. 28, Oct. 1, 1996, pp. 5529-5534.

(56) References Cited

OTHER PUBLICATIONS

Phillips et al., "Security Enhancement of Holograms with Interference Coatings", Optical Security and Counterfeit Deterrence Techniques III Proceedings of SPIE, vol. 3973, pp. 304-316 (2000).
I.M. Boswarva et al., "Roll Coater System for the Production of Optically Variable Devices (OVD's) for Security Applications", Proceedings, 33rd Annual Technical Conference, Society of Vacuum Coaters, pp. 103-109 (1990).
J.A. Dobrowolski, "Optical Thin-Film Security Devices", Optical Security Document, Rudolf Van Renesse, Artech House, 1998, pp. 289-328.
J.A. Dobrowolski et al., "Optical Interference Coatings for Inhibiting of Counterfeiting", Optica Acta, 1973, vol. 20, No. 12, pp. 925-037.
Dobrowolski et al., "Research on Thin Film Anticounterfeiting Coatings at the National Research Council of Canada", Applied Optics, vol. 28, No. 14, pp. 2701-2717 (Jul. 15, 1989).
DeFilet, LGZ Landis & Gyr Zug Corporation, "Kinegrams 'Optical Variable Devices' (OVD's) for Banknotes, Security Documents and Plastic Cards", San Diego, CA, Apr. 1-3, 1987.
Domnick et al., "Influence of Nanosized Metal Clusters on the Generation of Strong Colors and Controlling of their Properties through Physical Vapor Deposition (PVD)", 49th Annual Technical Conference Proceedings, Society of Vacuum Coasters, (2006).
Gale, Scherrer, "Diffractive Microstructures for Security Applications: Institute, Zurich, IEEE Conference Publication London 1991", Sep. 16-18, 1991, pp. 205-209.
Halliday et al., "Fundamental of Physics, Sixth Edition", Jul. 2000, p. 662.
Hardin, "Optical tricks designed to foil counterfeiters", OE Reports, No. 191, Nov. 1999.
Himpsel et al., "Nanowires by Step Decoration", Mat. Research Soc. Bul., Aug. 1999. pp. 20-24.
Llewellyn, "Dovids: Functional Beauty—discussion about holography", Paper, Film, and Foil Converter, Aug. 2002.
Lotz et al., "Optical Layers on Large Area Plastic Films", Precision, Applied Films, Nov. 2001.
McGrew, "Hologram Counterfeiting: Problems and Solutions", SPIE, vol. 1210, Optical Security and Anticounterfeiting Systems, 1990, pp. 66-76.
McGrew, "Countermeasures Against Hologram Counterfeiting", Internet site www.iea.com/nli/imblicalHons/countermeasures.htm, Jan. 6, 2000.
McKiernan et al., "Luminescence and Laser Action of Coumarin Dyes Doped in Silicate and Aluminosilicate Glasses Prepared by Sol-Gel Technique", Journal of Inorganic and Organometallic Polymers, vol. 1, No. 1, 1991, pp. 87-103.
Powell et al. (Ed)., "Vapor Deposition", John Wiley & Sons, 1996, p. 132.
Prokes and Wang (Ed)., "Novel Methods ofNanoscale Wire Formation", Mat. Reseach Soc. Bul., Aug. 1999, pp. 13-14.
Rolfe, "Optically Variable Devices for use on Bank Notes", SPIE, vol. 1210, Optical Security and Anticounterfeiting Systems, 1990, pp. 14-19.
van Renesse, "Security Design of Valuable Documents and Products", SPIE, vol. 2659, Jun. 1996, pp. 10-20.
van Renesse, "Paper Based Document Security—a Review", European Conference on Security and Detection, Apr. 28-30, 1997, Conference Publication No. 437, pp. 75-80.
van Renesse (Ed)., "Optical Document Security", 2nd Ed., Artech House, vol. 254, 1997, pp. 349-369.
Tomkins, Hastings, "Transparent Overlays for Security Printing and Plastic ID Cards", Nov. 1997, pp. 1-8.
Zink et al., "Optical Probes and Properties of Aluminosilicate Glasses Prepared by the Sol-Gel Method", Polym. Mater. Sci. Eng., 1989, pp. 204-208.
OVD Kinegram Cor "OVD Kinegram Management of Light to Provide Security" Internet site w-ww.kil.megram.com.xhome.html, Dec. 17, 1999.
The Mearl Corporation Brochure for "Mearl Iridescent Film", Peekskill, NY, 1986.
The R.D. Mathis Company Manual for "Thin Film Evaporation Source Reference", Long Beach, CA, Oct. 2001.
Definition of "directly" from Webster's Third New International Dictionary, 1993, p. 641.
European Search Report for EP Application No. 09177912, Jan. 19, 2010.

* cited by examiner

METHOD AND APPARATUS FOR ORIENTING MAGNETIC FLAKES

CROSS-REFERENCE TO RELATED APPLICATIONS

This application is a divisional of and claims priority to U.S. patent application Ser. No. 12/574,007, filed Oct. 6, 2009, which is a continuation-in-part from U.S. patent application Ser. No. 11/313,165 filed Dec. 20, 2005, which is a continuation-in-part of U.S. patent application Ser. No. 11/022,106 filed Dec. 22, 2004, now issued U.S. Pat. No. 7,517,578, which is a continuation-in-part of U.S. patent application Ser. No. 10/386,894 filed Mar. 11, 2003, now issued U.S. Pat. No. 7,047,883, which claims priority from U.S. Provisional Patent Application Ser. No. 60/410,546 filed Sep. 13, 2002, from U.S. Provisional Patent Application Ser. No. 60/410,547 filed Sep. 13, 2002, and from U.S. Provisional Patent Application Ser. No. 60/396,210 filed Jul. 15, 2002, the disclosures of which are hereby incorporated herein by reference in their entirety for all purposes.

This application is a divisional of and claims priority to U.S. patent application Ser. No. 12/574,007, filed Oct. 6, 2009, which is a continuation-in-part from U.S. patent application Ser. No. 11/623,190 filed Jan. 15, 2007, which claims priority from U.S. Provisional Patent Application Ser. No. 60/759,356, filed Jan. 17, 2006, and U.S. Provisional Patent Application Ser. No. 60/777,086 filed Feb. 27, 2006, which is a continuation-in-part application of U.S. patent application Ser. No. 11/552,219 filed Oct. 24, 2006 and U.S. patent application Ser. No. 11/278,600 filed Apr. 4, 2006, which claims priority from U.S. Provisional Patent Application Ser. No. 60/668,852 filed Apr. 6, 2005 and U.S. Provisional Patent Application Ser. No. 60/777,086 filed Feb. 27, 2006; both of which are continuation-in-part applications of U.S. patent application Ser. No. 11/313,165 filed Dec. 20, 2005, which is a continuation-in-part application of U.S. patent application Ser. No. 11/022,106, now U.S. Patent Application Publication No. 2005/0106367, filed Dec. 22, 2004, which is a continuation-in-part application of U.S. patent application Ser. No. 10/386,894 filed Mar. 11, 2003, now U.S. Pat. No. 7,047,883, issued May 23, 2006, which claims priority from U.S. Provisional Patent Application Ser. No. 60/410,546 filed Sep. 13, 2002, from U.S. Provisional Patent Application Ser. No. 60/410,547 filed Sep. 13, 2002, and from U.S. Provisional Patent Application Ser. No. 60/396,210 filed Jul. 15, 2002, the disclosures of which are hereby incorporated in their entirety for all purposes. U.S. patent application Ser. No. 11/623,190 filed Jan. 15, 2007 is also a continuation-in-part application of U.S. patent application Ser. No. 11/560,927 filed Nov. 17, 2006, which claims priority from U.S. Provisional Patent Application Ser. No. 60/737,926, filed Nov. 18, 2005, the disclosures of which are incorporated herein by reference in it entirety for all purposes.

This application is a divisional of and claims priority to U.S. patent application Ser. No. 12/574,007, filed Oct. 6, 2009, which claims priority from U.S. Provisional Patent Application Ser. No. 61/104,289 filed Oct. 10, 2008, which is incorporated herein by reference for all purposes.

TECHNICAL FIELD

The present invention relates generally to optically variable pigments, films, devices, and images and, more particularly, to aligning or orienting magnetic flakes during a painting or printing process, to obtain an illusive optical effect.

BACKGROUND OF THE INVENTION

Optically variable devices are used in a wide variety of applications, both decorative and utilitarian. Optically variable devices can be made in variety of ways to achieve a variety of effects. Examples of optically variable devices include the holograms imprinted on credit cards and authentic software documentation, color-shifting images printed on banknotes, and enhancing the surface appearance of items such as motorcycle helmets and wheel covers.

Optically variable devices can be made as film or foil that is pressed, stamped, glued, or otherwise attached to an object, and can also be made using optically variable pigments. One type of optically variable pigment is commonly called a color-shifting pigment because the apparent color of images appropriately printed with such pigments changes as the angle of view and/or illumination is tilted. A common example is the "20" printed with color-shifting pigment in the lower right-hand corner of a U.S. twenty-dollar bill, which serves as an anti-counterfeiting device.

Some anti-counterfeiting devices are covert, while others are intended to be noticed. Flakes having covert features therein, such as indicia, gratings, and holographic features, can be used in addition to overt features. Furthermore flakes with can be used. Unfortunately, some optically variable devices that are intended to be noticed are not widely known because the optically variable aspect of the device is not sufficiently dramatic. For example, the color shift of an image printed with color-shifting pigment might not be noticed under uniform fluorescent ceiling lights, but more noticeable in direct sunlight or under single-point illumination. This can make it easier for a counterfeiter to pass counterfeit notes without the optically variable feature because the recipient might not be aware of the optically variable feature, or because the counterfeit note might look substantially similar to the authentic note under certain conditions.

Optically variable devices can also be made with magnetic pigments that are aligned with a magnetic field after applying the pigment (typically in a carrier such as an ink vehicle or a paint vehicle) to a surface. However, painting with magnetic pigments has been used mostly for decorative purposes. For example, use of magnetic pigments has been described to produce painted cover wheels having a decorative feature that appears as a three-dimensional shape. A pattern was formed on the painted product by applying a magnetic field to the product while the paint medium still was in a liquid state. The paint medium had dispersed magnetic non-spherical particles that aligned along the magnetic field lines. The field had two regions. The first region contained lines of a magnetic force that were oriented parallel to the surface and arranged in a shape of a desired pattern. The second region contained lines that were non-parallel to the surface of the painted product and arranged around the pattern. To form the pattern, permanent magnets or electromagnets with the shape corresponding to the shape of desired pattern were located underneath the painted product to orient in the magnetic field non-spherical magnetic particles dispersed in the paint while the paint was still wet. When the paint dried, the pattern was visible on the surface of the painted product as the light rays incident on the paint layer were influenced differently by the oriented magnetic particles.

Similarly, a process for producing of a pattern of flaked magnetic particles in fluoropolymer matrix has been described. After coating a product with a composition in liquid form, a magnet with desirable shape was placed on the underside of the substrate. Magnetic flakes dispersed in a liquid organic medium orient themselves parallel to the magnetic field lines, tilting from the original planar orientation. This tilt varied from perpendicular to the surface of a substrate to the original orientation, which included flakes essentially parallel to the surface of the product. The planar oriented flakes reflected incident light back to the viewer, while the reoriented flakes did not, providing the appearance of a three dimensional pattern in the coating. It is desirable to create more noticeable optically variable security features on financial documents and other products and to provide features that are difficult for counterfeiters to copy.

It is also desirable to create features which add to the realism of printed images made with inks and paints having alignable flakes therein, especially printed images of objects and more particularly recognizable three dimensional objects.

Heretofore, in patent application PCT/US2003/020665 the inventor of the present application has described the "rolling-bar" and the "flip-flop" images which provide kinematic features, that is features which provide the optical illusion of movement, to images comprised of magnetically alignable pigment flakes wherein the flakes are aligned in a particular manner.

It has been discovered that providing a rolling bar used as a fill within an outline of a curved recognizable object, particularly a smooth curved recognizable object such as a bell, a shield, container, or a soccer ball provides striking effects that reach beyond a rolling bar moving back and forth on a rectangular sheet. The bar while providing realistic dynamic shading to an image of an object not only appears to move across the image but also appears to grow and shrink or expand and contract with this movement within the closed region in which it is contained. In some instances where the size or area of the bar doesn't vary, for example wherein it is used a as a partial fill within an image between two conforming curved lines that move together with a space between, filled by the bar, the bar appears to move across the image while simultaneously moving up and down. Thus, a highly desired optical effect is provided by using the rolling bar inside a non rectangular outlined closed shape of an object, wherein the area of the rolling bar changes as the bar moves across the image, and, or wherein the bar appears to move horizontally and vertically simultaneously as the image is tilted or the light source upon the image is varied. Additionally, if the bar is designed to be of a suitable size and radius of curvature, it can be used as a dynamic, moving, shrinking or expanding shading element in the image, providing exceptional realism. It has also been found, that the rolling bar appears to have a most profound effect when it appears to mimic moving shading on an image of a real object that is capable or producing a shadow when light is incident upon it. In these important applications, it is preferred that the radius of curvature of the flakes forming the rolling bar be within a range of values wherein the image of the real-object it is applied to, appears to be correctly curved so as to appear realistic.

Patent Publication EP 710508A1 to Richter et al. (hereinafter "Richter") discloses methods for providing three dimensional effects by drawing with magnetic tips. Richter describes three dimensional effects achieved by aligning magnetically active pigments in a spatially-varying magnetic field. Richter uses standard pigments (barium ferrite, strontium ferrite, samarium/cobalt, Al/Co/Ni alloys, and metal oxides made by sintering and quick quenching, none of which are composed of optical thin film stacks. Rather, the particles are of the hard magnetic type. Richter uses electromagnetic pole pieces either on top of the coating or on both sides of the coating. However, Richter uses a moving system and requires "drawing" of the image. The "drawing" method provides only limited optical effects. In particular, the "rolling-bar" and the "flip-flop" images can not be formed using this method.

The aforedescribed kinematic features, such as the "rolling-bar" and the "flip-flop" images, as well as images appearing to be 3-dimensional curved objects as a soccer ball, rely on particular, intrinsic flake patterns. By way of example, two parts of a "flip-flop" image should be clearly separated and a blurred border would downgrade the image quality. In order to form such intrinsic patterns, the high precision alignment of the flakes is required.

A method of painting an object with a paint containing magnetic flakes includes placing a magnet under or above the object's surface, painting the object using a spray gun, and leaving the object in place until the paint solvent evaporates. This method, as well as "drawing", takes time and is not conducive to production type processes.

The optically illusive images with kinematic features, such as the "rolling-bar" and the "flip-flop" images, as well as images appearing to be 3-dimensional curved objects like, provide highly visible security features. Such features attract a person's attention, are easy to verify and difficult to forge, thus they are used more extensively over time in different applications, such as currency, documents, packaging.

Mass production requires high-speed methods of manufacturing of such images while providing high precision alignment of the flakes therein.

Accordingly, an object of the present invention is to provide a method and apparatus for aligning of magnetic flakes with a high degree of precision performed at a speed suitable for mass production.

SUMMARY OF THE INVENTION

Accordingly, the present invention relates to a method of aligning magnetic flakes, which includes: (a) coating a substrate with a carrier having the magnetic flakes dispersed therein; (b) after step (a), moving the substrate in a magnetic field so as to align the magnetic flakes along force lines of the magnetic field in the absence of an effect from a solidifying means; and, (c) after step (b) and before the substrate reaches an exit field part of the magnetic field, at least partially solidifying the carrier using a solidifying means while further moving the substrate in the magnetic field so as to secure the magnetic flakes in the carrier while the magnetic field maintains alignment of the magnetic flakes.

Another feature of the present invention provides an apparatus for aligning magnetic flakes dispersed in a carrier, which includes: a support for supporting a substrate, movable along a support path; a dispenser for coating the substrate with the carrier having the magnetic flakes; a magnet assembly for aligning the magnetic flakes by a magnetic field, disposed along a first path segment of the support path, wherein the first segment comprises second and third path segments; and, a solidifying means for at least partially solidifying the carrier, disposed along the third path segment, wherein no solidifying means is disposed along the second path segment, so as to align the magnetic flakes by the magnetic field, when the magnetic flakes move on the support within the second path segment, and to secure the magnetic flakes in the carrier using the solidifying means while alignment of the magnetic flakes is maintained by the magnetic field, when the carrier with the magnetic flakes move on the support within the third path segment.

The support may be a belt, the magnet assembly can be in a form of an elongate assembly or a rotary magnet assembly.

In one embodiment of the apparatus, the substrate moves on a belt, an elongate magnet assembly is disposed under the belt and the solidifying means, e.g. a UV light or e-beam source, is disposed above the belt.

Another feature of the present invention provides a screen within the apparatus so as to protect the flakes from the effect of the solidifying/currying means during the aligning step of the aforementioned method.

One aspect of this invention provides an apparatus for aligning magnetic flakes in a carrier printed on a substrate. The apparatus includes: a rotatable roller comprising a magnet for creating a magnetic field emanating from an outer surface of the roller; a movable belt bending about the rotatable roller, for supporting the substrate and for moving the substrate proximate to the magnet along an arc on the outer surface of the rotatable roller, wherein the arc comprises first and second arc segments; and, a solidifying means for at least partially solidifying the carrier, disposed along the second arc segment, wherein no solidifying means is disposed along the first arc segment, so as to align the magnetic flakes by the magnetic field, when the magnetic flakes move on the support within the first arc segment, and to secure the magnetic flakes in the carrier using the solidifying means while alignment of the magnetic flakes is maintained by the magnetic field, when the carrier with the magnetic flakes move on the support within the second arc segment.

Yet another aspect of this invention provides an apparatus for aligning magnetic flakes dispersed in a carrier. The apparatus includes: a support for supporting a substrate with the magnetic flakes in the carrier, movable along a support path; a magnet assembly for providing a first magnetic field for aligning magnetic flakes into a first alignment; and, a solidifying station located in a predetermined position for at least partially solidifying the carrier, before the carrier exits the first magnetic field and before the carrier reaches an exit field which is provided by the magnet assembly and differs from the first field such that the flakes remain in said first alignment.

BRIEF DESCRIPTION OF THE DRAWINGS

Exemplary embodiments of the invention will now be described in accordance with the figures. Since the figures shown in this application represent the images in accordance with this invention, made with magnetic flakes, these effects cannot be provided in this document which attempts to describe and illustrate these kinematical and 3-D features.

DETAILED DESCRIPTION

Figure 1A:
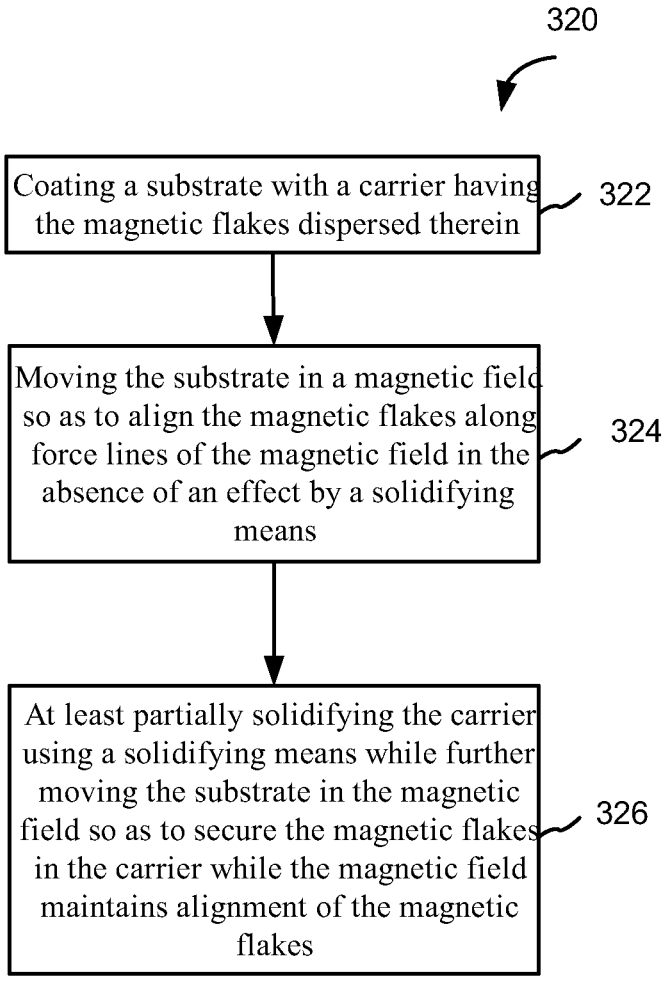
FIG. 1A is a simplified flow chart of a method of aligning magnetic flakes.

The present invention in its various embodiments solves the problem of pre-determined orientation of magnetic flakes of optically variable ink in a high-speed printing process. Normally, particles of an optically variable pigment dispersed in a liquid paint or ink vehicle generally orient themselves to be substantially parallel to the surface when printed or painted on to a surface. Orientation of reflective flakes parallel to the surface provides high reflectance of incident light from the coated surface. Magnetic flakes can be tilted while in the liquid medium by applying a magnetic field. The flakes generally align in such way that the longest diagonal of a flake follows a magnetic field line. Depending on the position and strength of the magnet, the magnetic field lines can penetrate the substrate at different angles, tilting magnetic flakes to these angles. A tilted reflective flake reflects incident light differently than a reflective flake that is parallel to the surface of the printed substrate. Reflectance and hue both vary dependent on the flake orientation. Tilted flakes typically look darker and have a different color than flakes parallel to the surface at a normal viewing angle.

Orienting magnetic flakes in printed images poses several problems. Conventional methods, which hold a magnet against a static (non-moving) coated article until the paint or ink dries, are not suitable for printing presses, because the inks used in such operations typically dry within milliseconds whereas, in a print press, a substrate moves at a speed of 100-160 meters per minute and would move relatively to the magnet before the ink dries thus distorting the image.

It was discovered that one way to align magnetic flakes on a substrate in order to obtain enhanced optical effects in the painted/printed image, is to move the substrate relative to a magnet so that the profile of the magnetic field does not change. Thus flakes, while physically moving through the magnetic field, would not have their position or orientation affected by this movement and would align the same way as in conventional methods wherein a substrate and a magnet are stationary.

The effect of moving through the field without being affected by the movement can be achieved by using a specially designed magnet assembly which extends along the substrate path and has magnetic lines perpendicular to the direction of movement of the substrate. In other words, painted or printed liquid paint or ink medium with dispersed magnetic flakes on the substrate moves perpendicular to magnetic lines of the field to cause re-orientation of the flakes.

However, we have discovered that moving the ink with magnetic flakes along the magnet assembly presents a problem associated with an exit field at a trailing edge of the magnet(s), where the magnetic field profile changes significantly in any direction, so it is impossible for the printed sample to pass the exit field without distorting the flake alignment. The importance of the exit field problem is associated with the intrinsic patterns necessary to provide kinematic features which rely on a difference between the alignment of different groups of flakes. By way of example, the "rolling bar" effect requires gradual change of the flake alignment in the direction where the bar "rolls," while the alignment of the flakes along the "bar" should be maintained in order to distinguish the "bar" shape. Such precision of the flake alignment has not been required from the magnetic imagining before, and the effect of the exit field at a trailing edge of the magnet(s) on the magnetically aligned flakes has not been addressed before.

To solve the exit field problem, the method of this invention includes a step of at least partially solidifying of the ink/paint before the sample has reached the exit field. With reference to FIG. 1A, a method 320 of aligning magnetic flakes includes: a coating step 322, when a substrate is coated with a carrier having the magnetic flakes dispersed therein, followed by an aligning step 324, wherein the substrate moves in a magnetic field so as to align the magnetic flakes along force lines of the magnetic field. A solidifying step 326 is performed after the aligning step 324 and before the substrate reaches an exit field part of the magnetic field, and includes at least partially solidifying the carrier using a solidifying means while further moving the substrate in the magnetic field so as to secure the magnetic flakes in the carrier while the magnetic field maintains alignment of the magnetic flakes. Notably, no solidifying means affect the carrier during the alignment step 324, when the flakes are moving within the carrier and may have not reached the desired orientation yet.

In the coating step 322, the carrier with flakes therein, e.g. in the form of ink or paint, is provided to the substrate. The flakes are non-spherical, preferably planar, magnetic flakes, i.e. pigment flakes that can be aligned using a magnetic field. They may or may not retain remnant magnetization. A typical flake is twenty microns across and about one micron thick. The image is printed or painted on the substrate, such as paper, plastic film, laminate, card stock, or other surface. The substrate may be a continuous roll, or a sequence of substrate sheets, or have any discrete or continuous shape. The substrate is supported by a support which may be a belt, a platform, a frame, etc. For convenience of discussion, the term "printed" will be used to generally describe the application of pigments in a carrier to a surface, which may include painting, ink jet printing, silk printing, intaglio printing, etc. The carrier can be a liquid or paste-like carrier, curable by the UV-light or e-beam source, e.g. a photopolymer, or a solvent-based carrier, including water-based.

Before the carrier dries or sets, the substrate is moved relative to a magnet assembly to orient the magnetic pigment flakes.

During the aligning step 324 and the solidifying step 326, a portion of the carrier with flakes, also referred to as "printed image," moves along a substrate path in the magnetic field provided by a magnet assembly perpendicular to force lines of the field.

As discussed above, it is desirable for the magnetic field to have a constant profile along the substrate path. The magnet assembly is designed so that the profile of the field, a cross-section of the field in a plane normal to the substrate path, changes very little while the substrate moves along the substrate path during the aligning step 324 and solidifying step 326, before the carrier is at least partially solidified in the solidifying step 326, so as to obtain an optically variable image resulting from the alignment of the flakes. In other words, during the steps 324 and 326, first and second cross-sections of the magnetic field in any first and second points of the substrate path are substantially a same desired field profile.

In some instances, the image may have additional optically variable effects, such as color-shifting. In a particular embodiment, the magnet assembly is configured to provide a flip-flop image. In another embodiment, the magnet assembly is configured to provide a rolling bar image. In some embodiments, the thin planar substrate is a sheet that is printed with several images. The images on the sheet can be the same or different, and different inks or paints can be used to print the images on the sheet. Similarly, different magnetic assemblies can be used to create different images on a single sheet of substrate. In other embodiments, the substrate can be an essentially continuous substrate, such as a roll of paper.

According to the method of this invention, the flakes are being aligned and secured while the substrate moves along the magnet assembly perpendicular to the field force lines. Thus, the cross-sectional profile of the field changes insignificantly, if at all, and the flakes are aligned and secured while affected by a substantially same field configuration. Advantageously, the step of securing the flakes in the carrier happens while the alignment of the flakes is maintained by the magnetic field, which ensures the desired flake pattern rendered with a high degree of precision. Since the printed image moves pass the magnetic assembly at a relatively high speed, the method of this invention is suitable for mass production of printed images having magnetic flakes aligned therein.

Figure 1B:
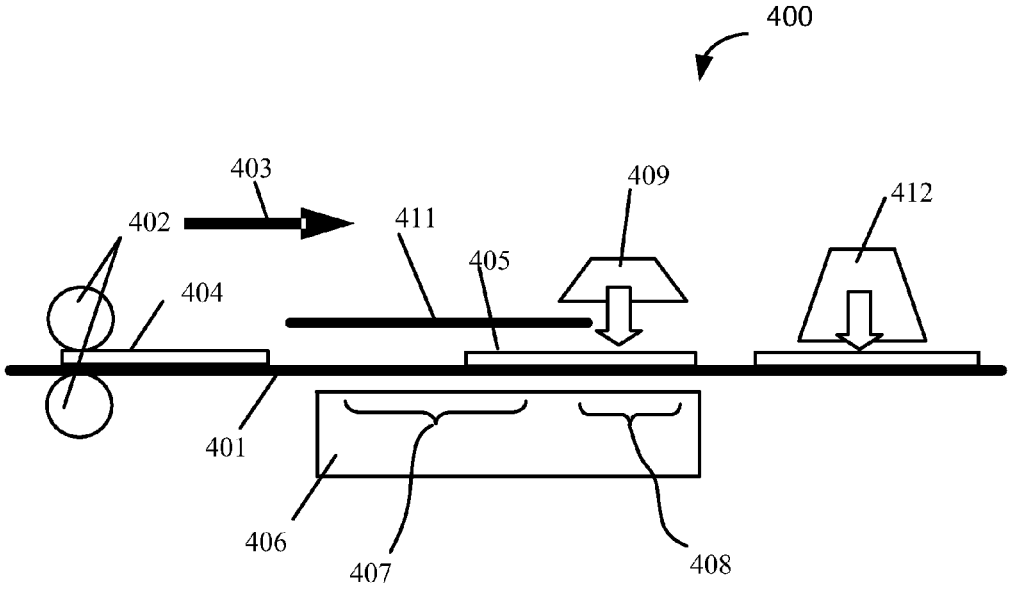
FIG. 1B is a simplified cross section of apparatus for aligning magnetic flakes according to an embodiment of the present invention.

An exemplary apparatus for aligning magnetic flakes dispersed in a carrier is shown in FIG. 1B. The apparatus 400 includes a magnet assembly 406, a support in the form of a belt 401 for supporting a substrate and a dispenser in the form of a printing press rollers 402 for coating the substrate with the carrier having the magnetic flakes. The apparatus 400 also includes a solidifying means 409 for partial solidifying or complete solidifying (curing) the carrier with aligned magnetic flakes.

The belt 401 passes through the rollers 402 of the printing press in a direction 403. The carrier printed onto the substrate 404 is supported by the belt 401 and moves along a support path, which, in this instance, coincides with the belt 401. The substrate 404, further referred to as "image 404," is shown in FIG. 1B in several positions and is also referred to as an "image 405."

The wet ink of the image on the substrate 404 contains magnetic flakes. When the flakes in the ink approach a linear magnet assembly 406, they start to change their orientation following magnetic lines of the field. While moving through an alignment segment 407 of the substrate path, the flakes have enough time to orient in the direction of the field in this region. Moving further with the belt 401, the flakes approach and subsequently enter a solidifying segment 408 of the substrate path. A solidifying means 409, e.g. a UV lamp, e-beam source, or a heater, is installed above of the assembly 406, so as to illuminate the image 405. Of course any solidifying source compatible with the carrier can be used. UV-curing or e-beam curing cause almost instantaneous solidifying of the carrier. Solidifying solvent-based carriers with a heat source or drier requires more time and evaporation of the solvent may cause the thickness of the ink or paint layer to lessen up to 60% , whereas UV- or e-beam curable organic carriers do not shrink when cure.

When the printed image 405 is within the solidifying segment 408, the solidifying means 409 secure the magnetic flakes in the carrier within the image 405, while the alignment of the magnetic flakes is maintained by the magnetic field of the magnet assembly 406.

A screen 411 prevents solidifying of the ink or paint when the printed image 405 is in the alignment segment 407 where the flakes change their orientation. The light screen prevents solidifying of the carrier in the areas of the image where the flakes were not aligned yet. By way of example, the shield is made from a non-magnetic sheet metal having thickness in the range of 0.01" to 0.1" and extends along a half of the magnetic assembly length from the point of the first contact of the printed image and the magnets. The screen 411 is not necessary if the solidifying means 409, e.g. a UV light source, is mounted very close to the belt 401. However, the screen 411 prevents the wet image 405 from any possible scattered or diffused UV light radiated from the lamp that can cause partial solidifying of the ink while the image 405 is in the alignment segment 407 of the substrate path.

The solidifying of the ink in the segment 408 can be either full or partial. When the solidifying means 409 only partially solidifies the carrier, another solidifying source 412 may be used downstream along the belt 401.

Figure 4:
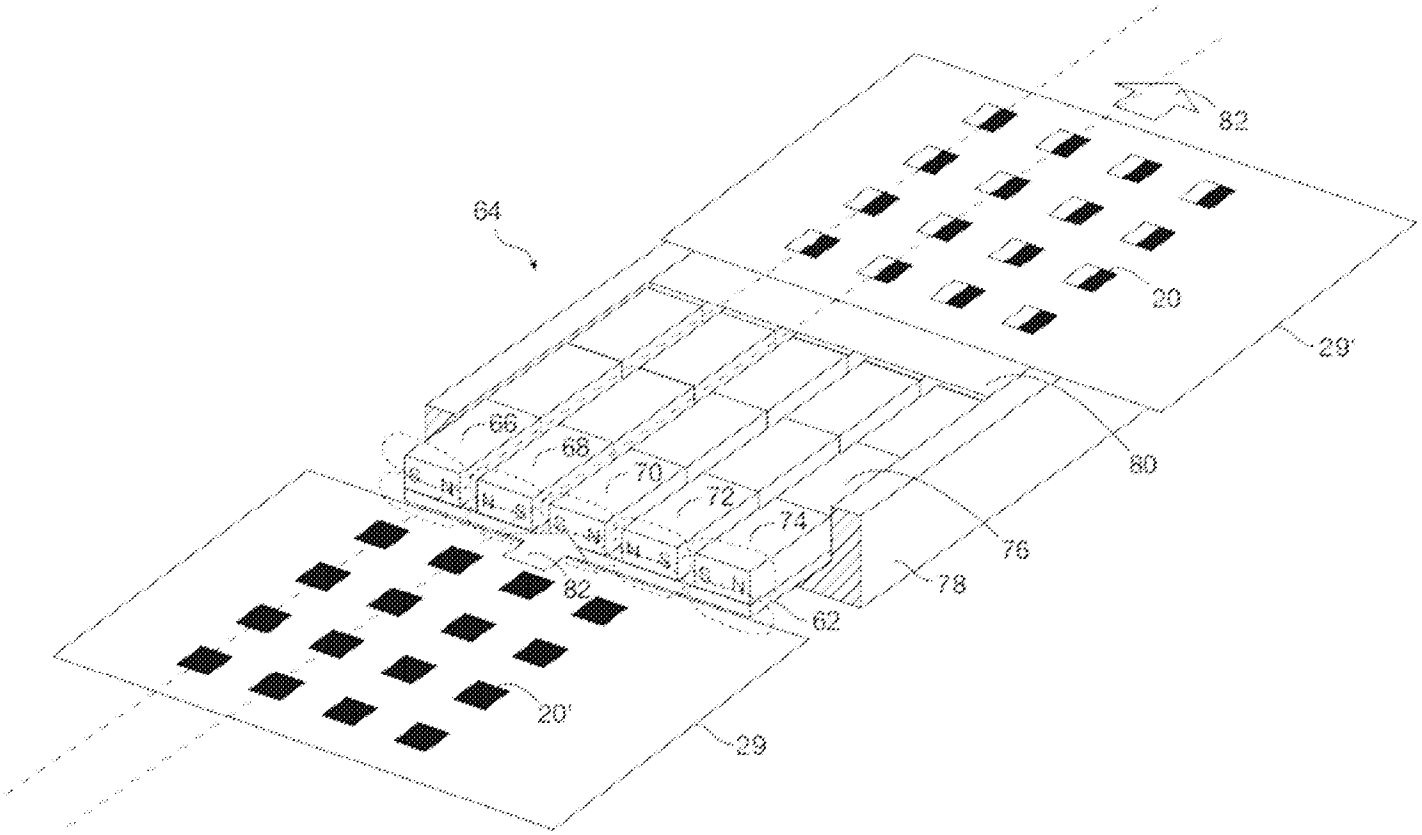
FIG. 4 is a simplified schematic of a magnet assembly that can be installed in the in-line printing or painting equipment.
Figure 6:
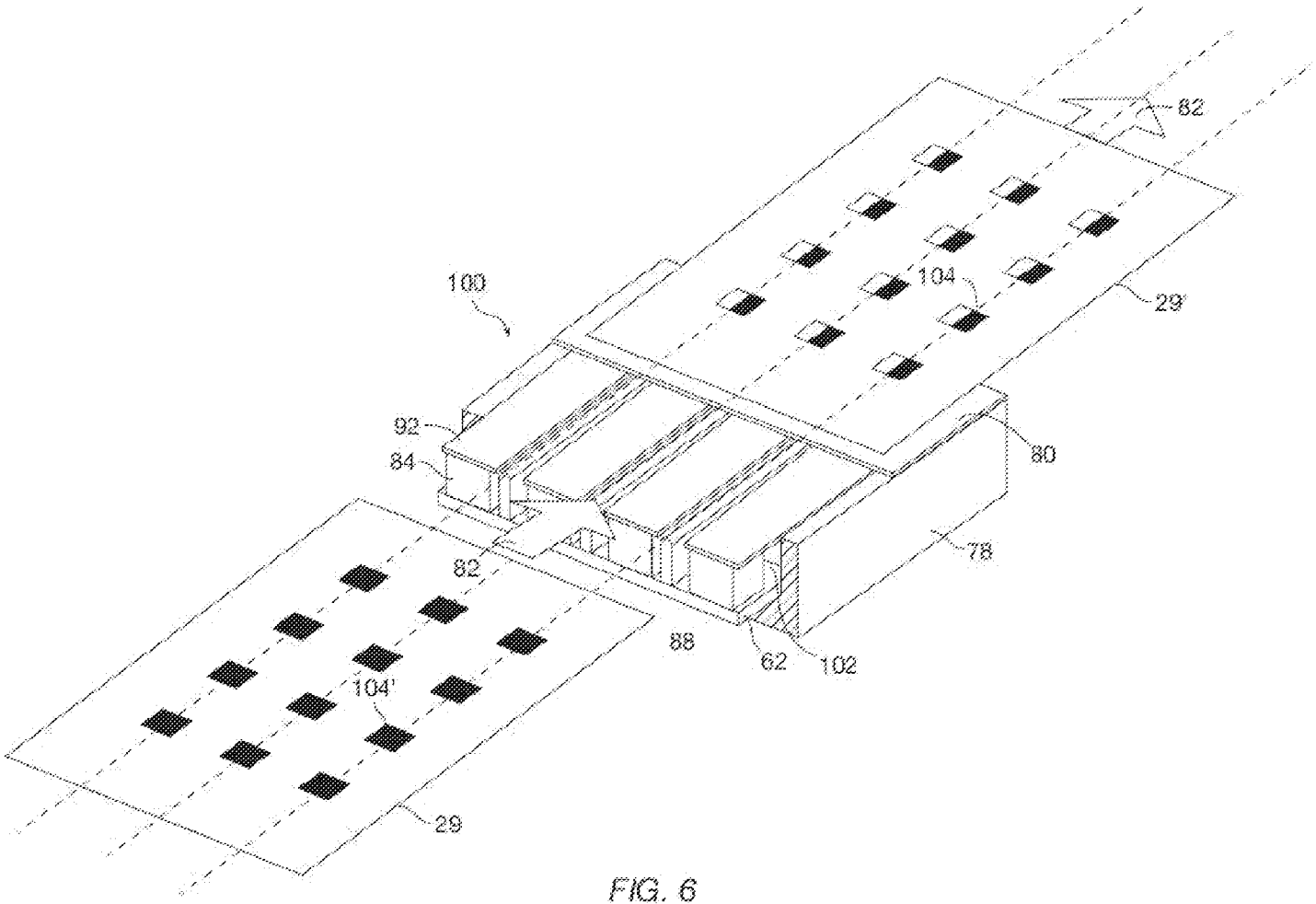
FIG. 6 is a simplified schematic of a magnet assembly that can be installed in the in-line printing or painting equipment.
Figure 8:
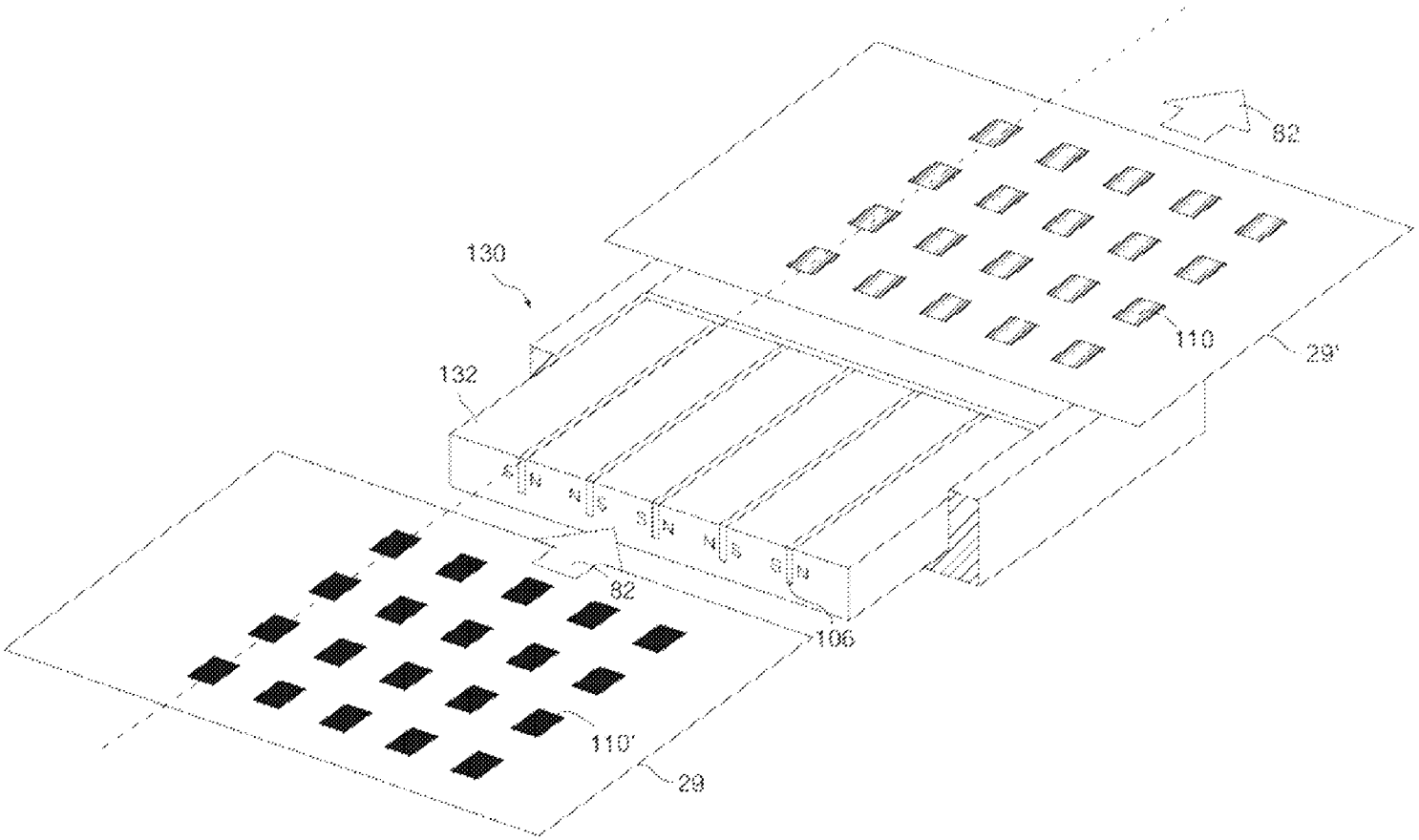
FIG. 8 is a simplified schematic of an apparatus for printing rolling bar images according to an embodiment of the present invention that can be installed in the in-line printing or painting equipment

The magnet assembly may be an elongate assembly including one or more permanent magnets with North and South poles at long surfaces of the magnets. Exemplary magnet assemblies are shown in FIGS. 4, 6, and 8 and are described further herein. The elongate assembly may be formed of elongate magnet(s), as shown in FIGS. 6 and 8, or row(s) of magnets, as shown on FIG. 4.

In the apparatus 400, the belt supporting a printed image moves along the support path, which is a straight line. However, in accordance with this invention, a support supporting a printed image may move along a curve as soon as it follows the surface of a magnet assembly and the support moves orthogonally to force lines of the magnetic field so as to ensure that the profile of the field is a substantially same profile, i.e. it changes insignificantly along the support path in the proximity of the magnet assembly.

Figure 1C:
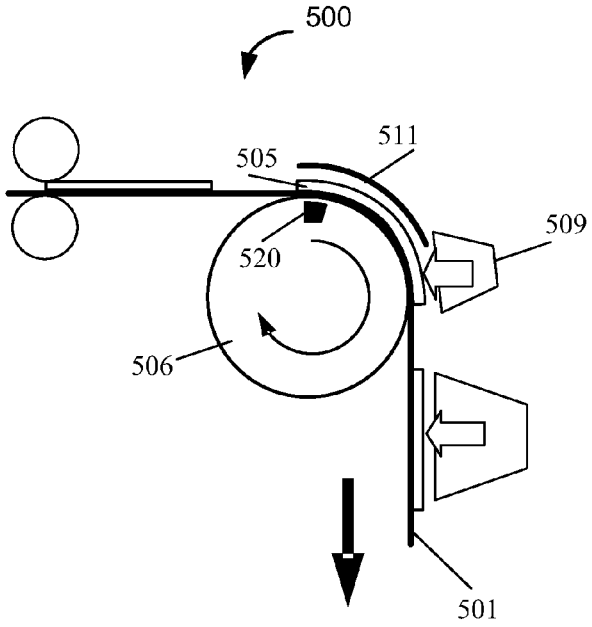
FIG. 1C is a simplified cross section of apparatus for aligning magnetic flakes according to another embodiment of the present invention.

FIG. 1C shows an apparatus 500 for aligning magnetic flakes dispersed in a carrier. Differently from the apparatus 400 shown in FIG. 1B, the apparatus 500 has a belt 501 which bends about a rotary magnet assembly 506.

Figure 12A:
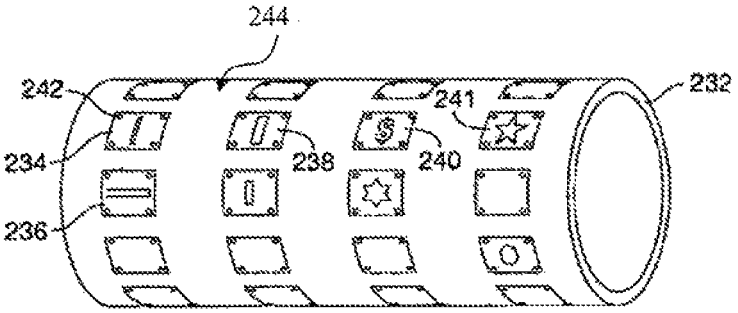
FIG. 12A is a simplified perspective of one embodiment of the roller with magnetic assemblies for use in the apparatus illustrated in FIG. 1C.

The magnet assembly 506 includes a rotatable roller and one or more magnets 520 along the cylindrical surface thereof for creating a magnetic field emanating from an outer surface of the roller. The belt 501 moves while bending about the roller so that a substrate path is an arc on the outer surface of the roller. A substrate 505 with magnetic flakes thereon for a period of time moves together with the magnet 520 along the arc, initially without being affected by a solidifying means 509, e.g. protected by a screen 511 and, then, under the solidifying means 509 for at least partially solidifying the carrier and securing the flakes while their alignment is maintained by the magnet 520. The solidifying means 509 may be a UV- or e-beam source, a heater, or a drier. Exemplary rotary magnet assemblies are shown in FIGS. 12A,B.

Fixing magnetic flakes in a predetermined orientation on the fast moving support in the last segment of the support path right before the exit field allows printing of images with very crisp optical effects. The flakes come to the exit field of a magnet assembly with their orientation permanently or partially fixed.

This method provides remarkable illusive optical effects in the printed image. One type of optical effects will be referred to as a kinematic optical effect for purposes of discussion. An illusive kinematic optical effect generally provides an illusion of motion in the printed image as the image is tilted relative to the viewing angle, assuming a stationary illumination source. Another illusive optical effect provides virtual depth to a printed, two-dimensional image. Some images may provide both motion and virtual depth. Another type of illusive optical effects switches the appearance of a printed field, such as by alternating between bright and dark colors as the image is tilted back and forth.

Figure 2A:
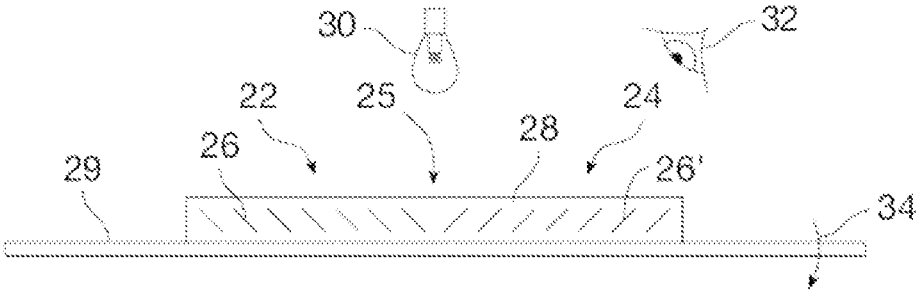
FIG. 2A is a simplified cross section of a printed image that will be referred to as a "flip-flop."

FIG. 2A is a simplified cross section of a printed image 20 that will be referred to as a "switching" optical effect, or "flip-flop", for purposes of discussion, according to an embodiment of the present invention. The flip-flop includes a first printed portion 22 and a second printed portion 24, separated by a transition 25. Pigment flakes 26 surrounded by carrier 28, such as an ink vehicle or a paint vehicle have been aligned parallel to a first plane in the first portion, and pigment flakes 26' in the second portion have been aligned parallel to a second plane. The flakes are shown as short lines in the cross-sectional view. The flakes are magnetic flakes, i.e. pigment flakes that can be aligned using a magnetic field. They might or might not retain remnant magnetization. Not all flakes in each portion are precisely parallel to each other or the respective plane of alignment, but the overall effect is essentially as illustrated. The figures are not drawn to scale. A typical flake might be from 1 to 500 microns across and 0.1 to 100 micron thick, hence the figures are merely illustrative. The image is printed or painted on a substrate 29, such as paper, plastic film, laminate, card stock, or other surface. For convenience of discussion, the term "printed" will be used to generally describe the application of pigments in a carrier to a surface, which may include other techniques, including techniques others might refer to as "painting".

Generally, flakes viewed normal to the plane of the flake appear bright, while flakes viewed along the edge of the plane appear dark. For example, light from an illumination source 30 is reflected off the flakes in the first region to the viewer 32. If the image is tilted in the direction indicated by the arrow 34, the flakes in the first region 22 will be viewed on-end, while light will be reflected off the flakes in the second region 24. Thus, in the first viewing position the first region will appear light and the second region will appear dark, while in the second viewing position the fields will flip-flop, the first region becoming dark and the second region becoming light. This provides a very striking visual effect. Similarly, if the pigment flakes are color-shifting, one portion may appear to be a first color and the other portion another color.

The carrier is typically transparent, either clear or tinted, and the flakes are typically fairly reflective. For example, the carrier could be tinted green and the flakes could include a metallic layer, such as a thin film of aluminum, gold, nickel, platinum, or metal alloy, or be a metal flake, such as a nickel or alloy flake. The light reflected off a metal layer through the green-tinted carrier might appear bright green, while another portion with flakes viewed on end might appear dark green or other color. If the flakes are merely metallic flakes in a clear carrier, then one portion of the image might appear bright metallic, while another appears dark. Alternatively, the metallic flakes might be coated with a tinted layer, or the flakes might include an optical interference structure, such as an absorber-spacer-reflector Fabry-Perot type structure.

Figure 2B:
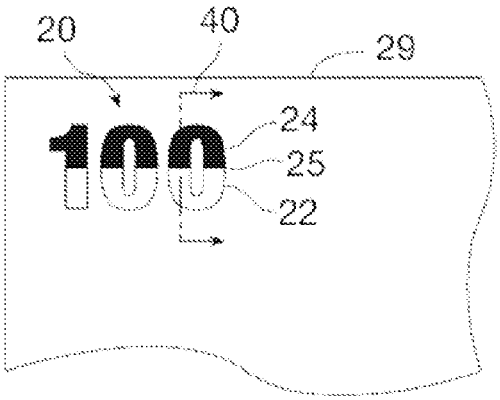
FIG. 2B is a simplified plan view of the printed image on a document at a first selected viewing angle.

FIG. 2B is a simplified plan view of the printed image 20 on the substrate 29, which could be a document, such as a bank note or stock certificate, at a first selected viewing angle. The printed image can act as a security and/or authentication feature because the illusive image will not photocopy and cannot be produced using conventional printing techniques. The first portion 22 appears bright and the second portion 24 appears dark. The section line 40 indicates the cross section shown in FIG. 2A. The transition 25 between the first and second portions is relatively sharp. The document could be a bank note, stock certificate, or other high-value printed material, for example.

Figure 2C:
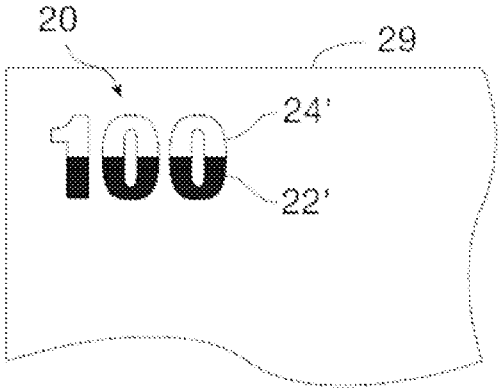
FIG. 2C is a simplified plan view of the printed image at a second selected viewing angle, obtained by tilting the image relative to the point of view.

FIG. 2C is a simplified plan view of the printed image 20 on the substrate 29 at a second selected viewing angle, obtained by tilting the image relative to the point of view. The first portion 22 now appears dark, while the second portion 24 appears light. The tilt angle at which the image flip-flops depends on the angle between the alignment planes of the flakes in the different portions of the image. In one sample, the image flipped from light to dark when tilted through about 15 degrees.

Figure 2D:
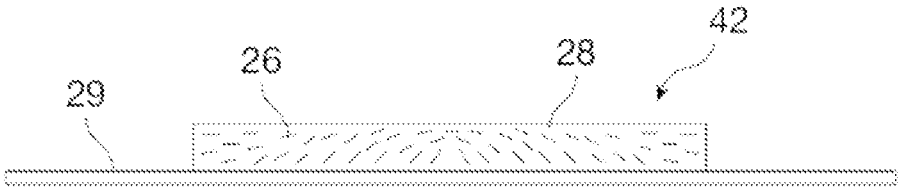
FIG. 2D is a simplified cross section of a printed image that will be referred to as a "rolling bar" for purposes of discussion, according to another embodiment of the present invention.

FIG. 2D is a simplified cross section of a printed image 42 of a kinematic optical device that will be referred to as a "rolling bar" for purposes of discussion, according to another embodiment of the present invention. The image includes pigment flakes 26 surrounded by a transparent carrier 28 printed on a substrate 29. The pigment flakes are aligned in a curving fashion. As with the flip-flop, the region(s) of the rolling bar that reflect light off the faces of the pigment flakes to the viewer appear lighter than areas that do not directly reflect the light to the viewer. This image provides a light band(s) or bar(s) that appear to move ("roll") across the image when the image is tilted with respect to the viewing angle (assuming a fixed illumination source(s)).

Figure 2E:
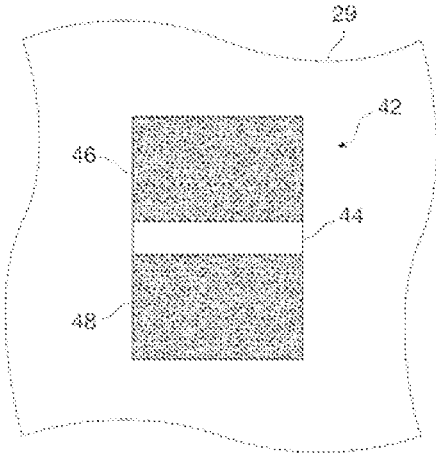
FIGS. 2E and 2F show plan views of the rolling bar image at first and second selected viewing angles respectively.
Figure 2F:
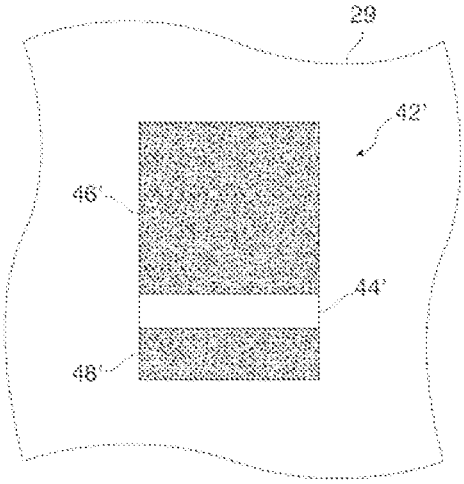

FIG. 2E is a simplified plan view of the rolling bar image 42 at a first selected viewing angle. A bright bar 44 appears in a first position in the image between two contrasting fields 46, 48. FIG. 2F is a simplified plan view of the rolling bar image at a second selected viewing angle. The bright bar 44' appears to have "moved" to a second position in the image, and the sizes of the contrasting fields 46', 48' have changed. The alignment of the pigment flakes creates the illusion of a bar "rolling" down the image as the image is tilted (at a fixed viewing angle and fixed illumination). Tilting the image in the other direction makes the bar appear to roll in the opposite direction (up).

The bar may also appear to have depth, even though it is printed in a plane. The virtual depth can appear to be much greater than the physical thickness of the printed image. The tilting of the flakes in a selected pattern reflects light to provide the illusion of depth or "3D", as it is commonly referred to. A three-dimensional effect can be obtained by placing a shaped magnet behind the paper or other substrate with magnetic pigment flakes printed on the substrate in a fluid carrier. The flakes align along magnetic field lines and create the 3D image after setting (e.g. drying or curing) the carrier. The image often appears to move as it is tilted, hence kinematic 3D images may be formed.

Flip-flops and rolling bars can be printed with magnetic pigment flakes, i.e. pigment flakes that can be aligned using a magnetic field. A printed flip-flop type image provides an optically variable device with two distinct fields that can be obtained with a single print step and using a single ink formulation. A rolling bar type image provides an optically variable device that has a contrasting band that appears to move as the image is tilted, similar to the semi-precious stone known as Tiger's Eye. These printed images are quite noticeable and the illusive aspects would not photocopy. Such images may be applied to bank notes, stock certificates, software documentation, security seals, and similar objects as authentication and/or anti-counterfeiting devices. They are particularly desirable for high-volume printed documents, such as bank notes, packaging, and labels, because they can be printed in a high-speed printing operation, as is described below.

Figure 3A:
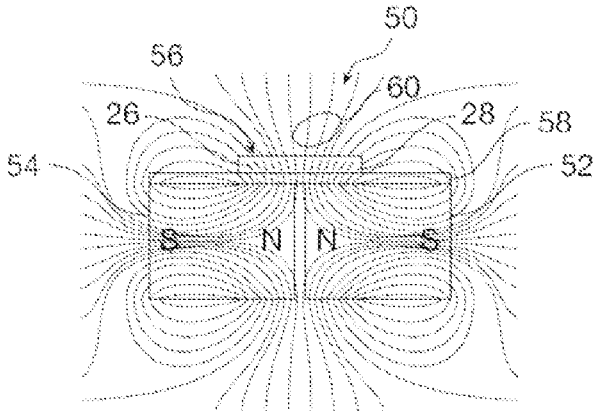
FIG. 3A is a simplified cross view of apparatus for producing a flip-flop type image.

FIG. 3A is a simplified cross view of a portion of an apparatus 50 for producing a flip-flop type image. The flakes 26 are arranged in a V-shaped manner where both branches of the V represent directions of the tilt and the apex represents a transition point. Such orientation of the flakes is possible when two magnetic fields oppose each other. Two magnets 52, 54 are aligned with opposing poles (in this case north-north). For the modeling purposes, the magnets were assumed to be 2"W by 1.5"H NdFeB magnets 40 MOe spaced 0.125 inches between the north poles. The type of magnet (material and strength) is selected according to the material of the flake, viscosity of the paint vehicle, and a substrate translation speed. In many cases, neodymium-boron-iron, samarium-cobalt, and/or ALNICO magnet can be utilized. The optimum distance between magnets is important for the formation of the uniformity of the optical effect for a particular printed image size.

The image 56 is printed on a thin printing or painting substrate 58, such as a sheet of paper, plastic, film, or card stock in a previous printing step, which is not illustrated in this figure. In a typical operation, several images are printed on the substrate, which is subsequently cut into individual documents, such as printing a sheet of banknotes that is cut into currency. The carrier 28 is still wet or at least sufficiently fluid to allow alignment of the magnetic flakes with the magnets. The carrier typically sets shortly after alignment to allow handling of the printed substrate without smearing the image. The magnetic flakes 26 follow direction of magnetic lines 60 and tilt.

Figure 3B:
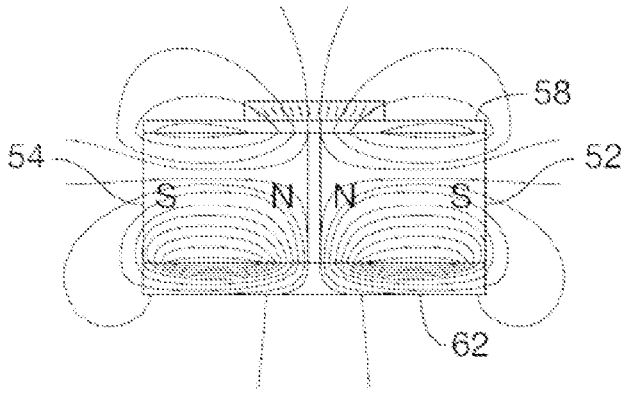
FIG. 3B is a simplified cross-section of apparatus for producing a flip-flop type image.

FIG. 3B is a simplified cross-section of a portion of an apparatus for producing a flip-flop type image where the magnets 52, 54 are mounted on a base 62 made from a metal alloy with high magnetic permeability, such as SUPERMALLOY. It is easier to make an assembly of several magnets if they are attached to a base, and the base provides a path for the magnetic field on the opposite side of the magnet, and alters the magnetic field lines on the print side of the assembly. The magnetic base acts as a shunt for the magnetic field and reduces the magnetic field behind ("underneath") the assembly, thus screening objects near the backside from high magnetic fields and forces. The magnetic base also holds the magnets securely in position without screws, bolts, welds, or the like. Magnetic field circulates inside the base 62 providing uniformity of the field between the magnets. The field is the most intensive in the gap between magnets and above it.

Figure 3C:
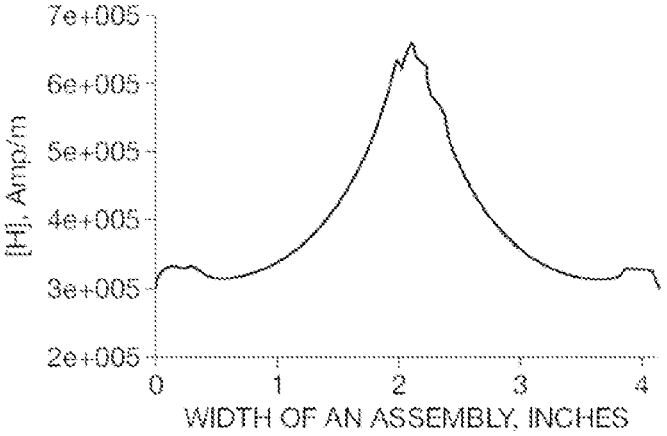
FIG. 3C illustrates the calculated magnitude of the field intensity across the apparatus of FIG. 3B.

FIG. 3C illustrates the calculated magnitude of the field intensity across the apparatus of FIG. 3B. Intensity is low near the edges of magnets, and becomes very high in the middle, providing a sharp transition between the flakes in adjacent portions of the image.

FIG. 4 is a simplified schematic of a magnet assembly 64 that can be installed in the in-line printing or painting equipment. Permanent magnets 66, 68, 70, 72, 74, 76 with their north and south poles indicated with "N" and "S", respectively, similar to those illustrated in FIG. 3B, are attached to the base 62 by magnetic attraction. The magnets may be magnetic bars, or may be segmented. That is, rows of magnets, e.g. 74, 76, etc., may be used. Plastic spacers (not shown in the picture) may be inserted between magnets to prevent their collision and provide safety. The assembly is enclosed in a case 78 and covered with a cover 80. The case and cover may be aluminum or other non-magnetic material.

A plastic or paper substrate 29 with printed fields 20'(e.g. squares or other shapes) moves at high speed over the top of the assembly in the direction of the arrows 82 in such way that gaps between two magnets, e.g. magnets 72 and 74, go through the centers of the printed fields. Alternatively, the gaps between the magnets may be offset from the centers of the printed fields. Similarly, the substrate could be a continuous roll, rather than sequential sheets. In many cases, several sets of images are printed on a sheet, and the sheet is cut into individual documents, such as bank notes, after the printing is completed.

After tilting of the flakes, the image 20 has an illusive optical effect. A drier for water- or solvent-based paints or inks (not shown in the picture) or UV-light source for photopolymers typically follows the magnet assembly shortly in the line to dry the ink or paint vehicle and fix re-oriented flakes in their aligned positions. It is generally desirable to avoid magnetizing flakes before application, as they may clump together. Pigment flakes with layers of nickel or PERMALLOY about 100-150 nm thick have been found to be suitable.

Figure 5A:
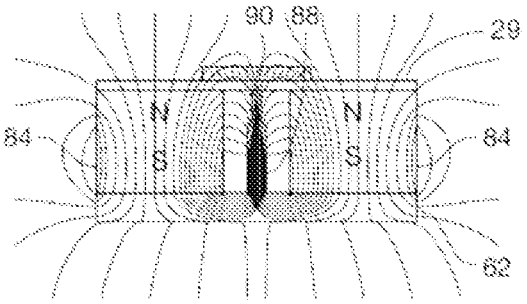
FIG. 5A is a simplified cross section of apparatus for producing a flip-flop type image with a sharper transition, according to an embodiment of the present invention.

FIG. 5A is a simplified cross section of an apparatus for producing a flip-flop type image with a sharper transition, according to an embodiment of the present invention. Two NdFeB magnets 84 (modeled as being 2"W by 1.5"H each) are placed on the magnetic base 62 facing with their north poles "up". The distance between magnets is about one inch. A blade 88 made of a high-permeability metal or metal alloy, such as SUPERMALLOY, is attached to the base between the magnets. The point of attack of the tip 90 of the blade is in the range of about 5 degrees to about 150 degrees. The blade re-shapes the magnetic field lines, pulling them closer and making the tip as a point where the magnetic field lines originate.

Figure 5B:
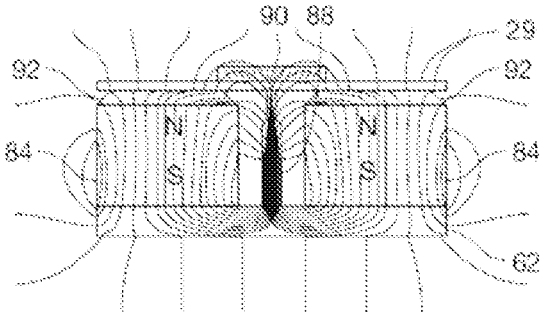
FIG. 5B is a simplified cross section of apparatus for producing an image according to another embodiment of the present invention.

FIG. 5B is a simplified cross section of an apparatus for producing an image according to another embodiment of the present invention. Shaped SUPERMALLOY caps 92 are placed on the top of magnets 84 to bend the magnetic field lines, as illustrated. The caps bend the field, bringing it closer to the tip, which makes the V-shape transition of the lines even sharper.

Figure 5C:
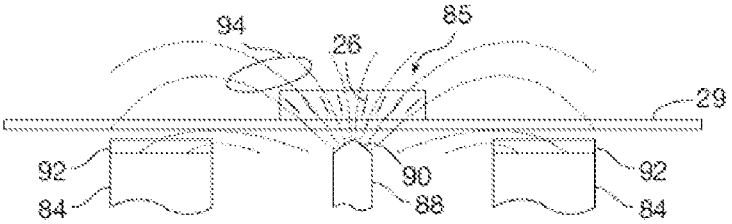
FIG. 5C is a simplified cross section of a portion of the apparatus illustrated in FIG. 5B, showing the orientation of the flakes in such a magnetic device.

FIG. 5C is a simplified cross section of a portion of the apparatus illustrated in FIG. 5B, showing the orientation of the flakes in such a magnetic device. The substrate 29 is placed on the top of the device sliding along the caps 92 (or magnets, in the case of FIG. 5A) in the direction from the viewer into the page. The printed image 85 is located above the tip. The flakes 26 follow magnetic lines 94 and tilt accordingly. This view more clearly shows the pointed nature of the tip of the blade, which produces a sharp transition between the two areas of the illusive image.

Figure 5D:
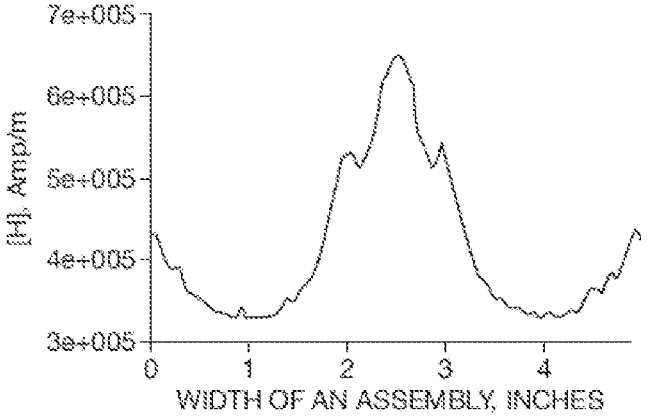
FIG. 5D is a graph illustrating the calculated magnitude of field intensity for the apparatus of FIGS. 5B and 5C.

FIG. 5D is a graph illustrating the calculated magnitude of field intensity for the apparatus of FIGS. 5B and 5C. The field intensity is narrower compared with the field intensity plot of FIG. 3C, and produces a sharper transition.

FIG. 6 is a simplified schematic of a magnet assembly 100 that can be installed in the in-line printing or painting equipment. Permanent magnets 84 with their north and south poles as illustrated in FIGS. 5A and 5B are mounted on a magnetic base 62. Alternatively, the south poles could be facing up. Cap plates 92 are magnetically attached to the top of magnets. Blades 88 are mounted on the base with their edges extending along the direction of translation 82 of the substrates 29, 29'. The in-line magnets 84 can be installed either next to each other or with a gap 102 between them. The magnet assembly is typically enclosed in a case 78 with a cover plate 80.

Fields 104' printed on the substrate 29 have generally non-oriented flakes. Some alignment of the flakes may occur as an artifact of the printing process, and generally some of the flakes tending to align in the plane of the substrate. When the substrate moves at high speed in the direction indicated by the arrow 82 above the magnet assembly, the flakes change their orientation along lines of the magnetic field forming an illusive image 104 (flip-flop). The image has two areas which reflect light in different directions and a relatively sharp border (transition) between them.

Figure 7A:
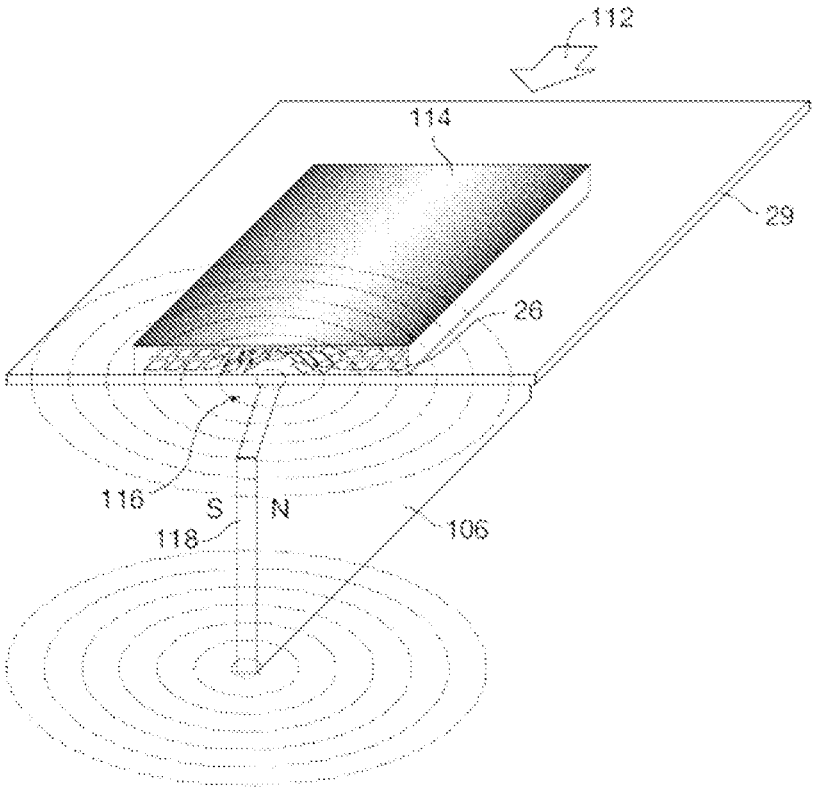
FIG. 7A is a simplified perspective view of an apparatus for forming a semi-circular orientation of flakes in paint or ink for a rolling bar type image.

FIG. 7A is a simplified perspective view of an apparatus for forming a semi-circular orientation of flakes in paint or ink for a rolling bar type image. A thin permanent magnet 106 has North and South poles at the side surfaces thereof. The substrate 29 with the printed magnetic flakes dispersed in a fluid carrier moves along the magnet from the viewer into the paper. The flakes 26 tilt along direction of the magnetic lines and form a semi-circle pattern above the magnet.

The substrate 29 moves across the magnet 106 in the direction of the arrow. The image 110 forms a rolling bar feature 114, which will appear to move up and down as the image is tilted or the viewing angle is changed. The flakes 26 are shown as being tilted in relation to the magnetic field lines. The image is typically very thin, and the flakes might not form a hump, as illustrated, but generally align along the magnetic field lines to provide the desired arched reflective properties to create a rolling bar effect. The bar appeared to roll up and down the image when tilted through an angle of about 25 degrees in one example.

It was found that the intensity of the rolling bar effect could be enhanced by chamfering 116 the trailing edge 118 of the magnet. It is believed that this gradually reduces the magnetic field as the image clears the magnet. Otherwise, the magnetic transition occurring at a sharp corner of the magnet might re-arrange the orientation of the flakes and degrade the visual effect of the rolling bar. In a particular embodiment, the corner of the magnet was chamfered at an angle of thirty degrees from the plane of the substrate. An alternative approach is to fix the flakes before they pass over the trailing edge of the magnet. By way of example, this could be done by providing a UV source part way down the run of the magnet, for a UV-curable carrier, or a drying source for evaporative carriers.

Figure 7B:
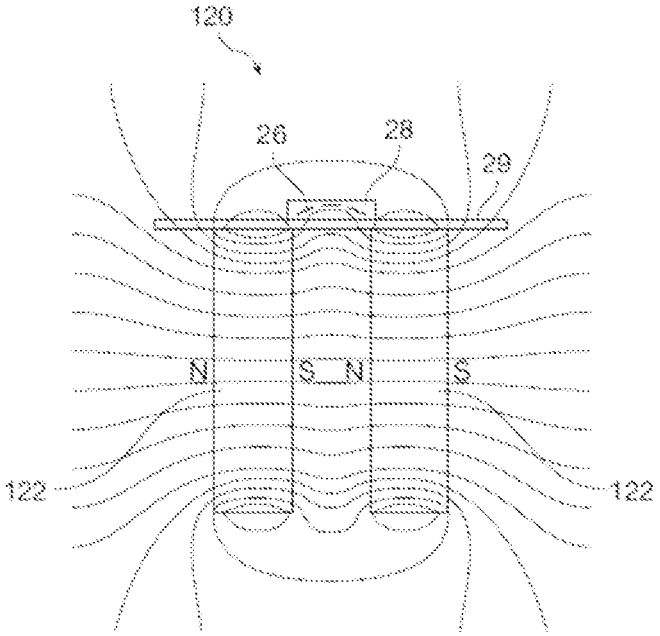
FIG. 7B is a simplified side view of an apparatus for forming a rolling bar image in accordance with another embodiment of the present invention.

FIG. 7B is a simplified side view of another apparatus 120 for forming a rolling bar image according to another embodiment of the present invention. The rolling bar effect is obtained using two magnets 122. The magnetic pigment flakes 26 orient themselves in the liquid carrier 28 along the oval magnetic field lines.

FIG. 8 is a simplified schematic of an apparatus 130 for printing rolling bar images according to an embodiment of the present invention that can be installed in the in-line printing or painting equipment. Thin vertical magnets 106, with their north-south polarization as shown, are installed in a plastic housing 132 that separates the magnets at selected distances, generally according to the location of the printed fields 110' on the substrate 29. The magnets are aligned in such fashion that they oppose each other. In other words, the north pole of one row of magnets faces the north pole of an adjacent row, while the south pole faces the south pole of an adjacent row of magnets from the other side.

In comparison to the magnetic devices shown in FIGS. 4 and 6, which have a base fabricated of highly permeable alloy for the mounting of the magnets and concentrating of a field strength just above the middle of the gap or above the tip of the blade, the apparatus FIG. 8 does not have a metallic base. A base made from a metal having high magnetic permeability would reduce the strength of a magnetic field on the side of the magnet that is responsible for the tilt of the flakes. Instead of the base, the magnets are inserted in slits of the plastic housing in such way that the upper part of the magnets goes underneath of the center of printed fields, but could be offset from the center. The substrate 29, 29' move at high speed atop the magnets in the direction of the arrows 82. Passing above the magnets, the flakes in the printed images orient themselves along lines of the magnetic field, creating an illusive optical effect in rolling bar image 110.

Figure 9A:
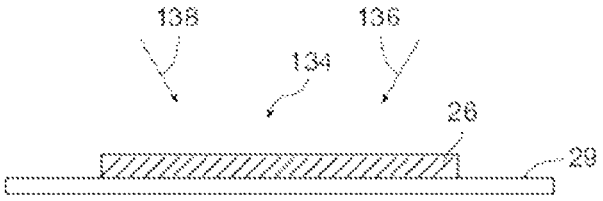
FIG. 9A is a simplified cross section of another optical effect that is possible to achieve using magnetic alignment techniques in high-speed printing processes.

FIG. 9A is a simplified cross section of another optical effect that is possible to achieve using magnetic alignment techniques in high-speed printing processes. The pigment flakes 26 in the image 134 are generally aligned parallel to each other, but not parallel to the surface of the substrate 29. Again, it is not necessary that each flake be perfectly aligned with each other flake, but the visual impression obtained is essentially in accordance with the illustration. Alignment of the majority of the flakes in the manner illustrated causes an interesting optical effect. The image looks dark when observed from one direction 136 and bright when observed from another direction 138.

Figure 9B:
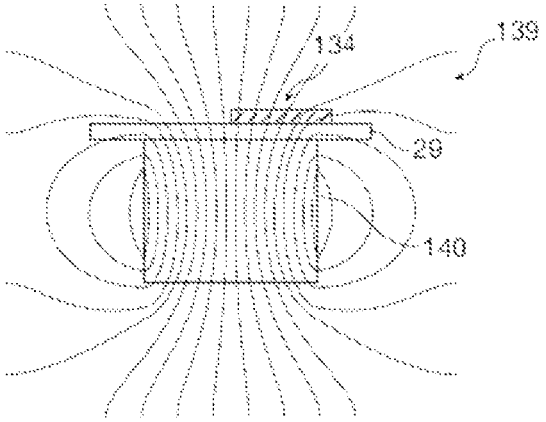
FIG. 9B is a simplified cross section of apparatus according to an embodiment of the present invention capable of producing the image illustrated in FIG. 9A.

FIG. 9B is a simplified cross section of an apparatus 139 according to an embodiment of the present invention capable of producing the image illustrated in FIG. 9A. A printed field 134 with still-wet paint or ink is placed above permanent magnet 140 with offset position relatively the magnet axes. The analysis of the magnetic field was modeled assuming a 2" by 1.5" NdFeB 40 MOe magnet. The magnitude of the field intensity is lower in the center of the magnet and higher towards its edges.

In general, electromagnets might be used in some embodiments, but it is difficult to obtain magnetic fields as high as can be obtained with current supermagnets in the confined spaces of a high-speed printing machine. The coils of electromagnetic also tend to generate heat, which can affect the solidifying time of the ink or paint and add another process variable. Nonetheless, electromagnetic may be useful in some embodiments of the invention.

Figure 9C:
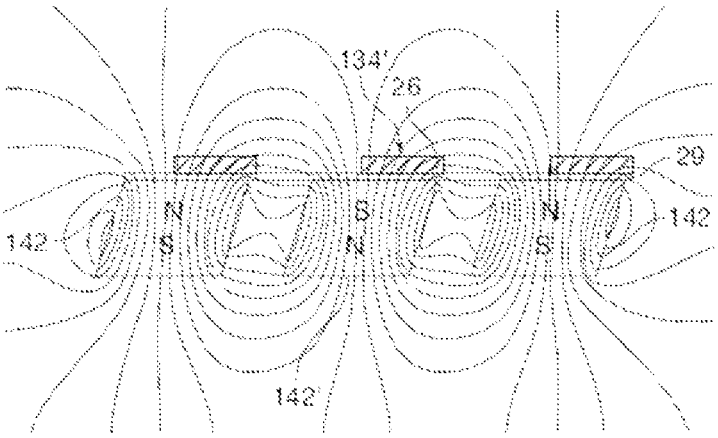
FIG. 9C is a simplified cross section of apparatus according to another embodiment of the present invention.

FIG. 9C is a simplified cross section of an apparatus according to another embodiment of the present invention. Magnets 142, 142' having a diamond-shaped cross section are used to spread the magnetic field and make it wider. The apparatus was modeled with three two-inches by one and a half inches NdFeB magnets arranged one inch from each other. The magnets show a cross-section of a magnet assembly for re-orientation of flakes in a magnetic field. The substrate 29 moves at a high speed in the direction from the viewer into the drawing. Two magnets have their north pole facing up while the intervening magnet 142' has its south pole facing up. Each magnet has the same field intensity as the magnets illustrated in FIG. 9B, but provides a wider area for placement of the field 134' for orienting the flakes 26.

Figure 9D:
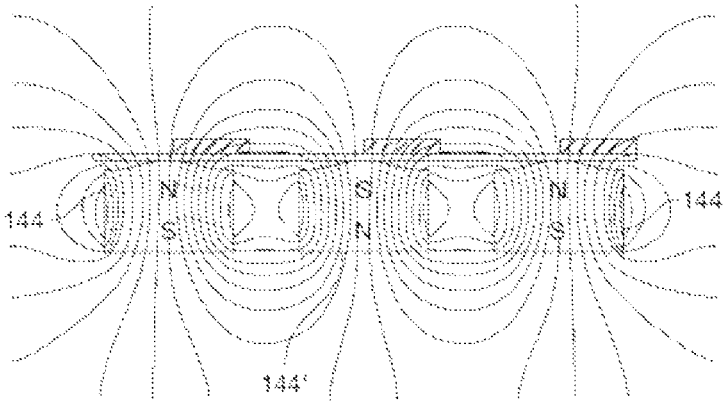
FIG. 9D is a simplified cross section of apparatus according to yet another embodiment of the present invention.

FIG. 9D is a simplified cross section of an apparatus according to yet another embodiment of the present invention. An effect similar to that obtained with the apparatus illustrated in FIG. 9C can be obtained with magnets 144, 144' having a roof-shaped cross-section, as well as with magnets having hexagonal, rounded, trapezoidal, or other cross-sections. Different shapes of magnets provide different performance that can create various printed or painted images with tilted flakes. For example, the magnitude of magnetic field intensity can be very different for magnets having different shapes (cross sections).

Figure 9E:
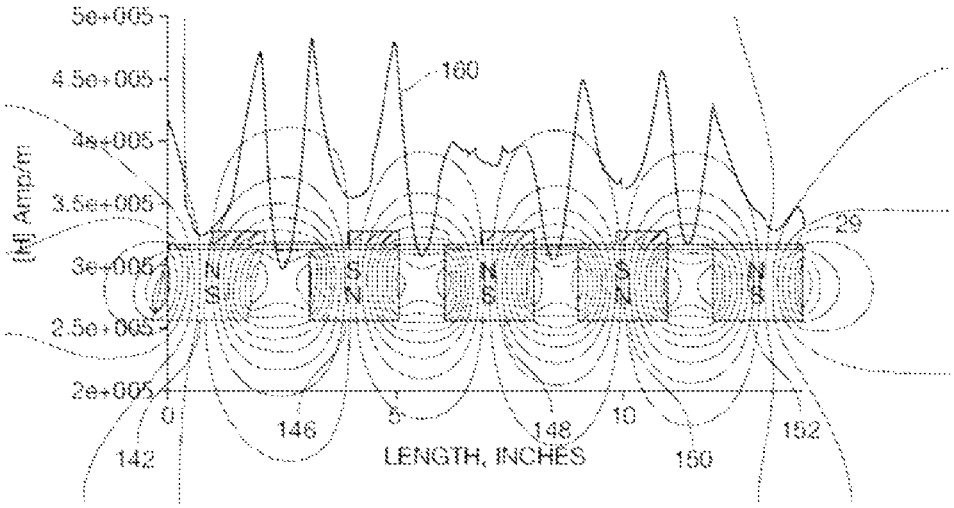
FIG. 9E illustrates the calculated magnetic field intensity for an associated five-magnet apparatus.

FIG. 9E illustrates the calculated magnetic field intensity for a five-magnet apparatus. The first magnet 142 is a diamond-shaped NdFeB 40 MOe magnet with dimensions close to 2" by 1.5" with its north pole facing up. The second magnet 146 is a rectangular 2" by 1.5" NdFeB 40 MOe magnet with its south pole facing the substrate 29. The third magnet 148 is a NdFeB 40 MOe magnet with rounded top.

This magnet has its north pole facing the substrate. The fourth magnet 150 has its south pole facing up, and is roof-shaped (with the angle of the tip being about 185°). The fifth magnet 152 is also roof-shaped but the angle of the tip is about 175°. The curve 160 shows the calculated magnitude of magnetic field intensity in this illustrative assembly. Shapes of the field intensity are different for different magnets. The field intensity is low in the center of rectangular, diamond and roof-shaped magnets while it becomes almost flat at 380,000 A/m for the rounded magnet 148. The curve shows that shaping of the magnet helps to get a field intensity that will be enough to provide a torque of the flake to orient it.

Figure 10A:
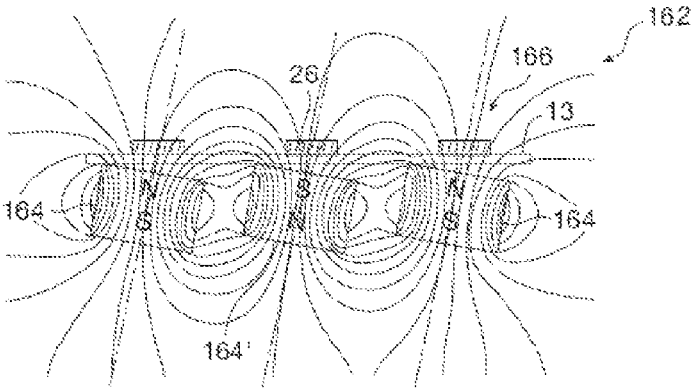
FIG. 10A is a simplified side view of an apparatus for printing illusive images that tilts magnetic flakes in a selected direction according to another embodiment of the present invention.

FIG. 10A is a simplified side view of an apparatus 162 according to an embodiment of the present invention that tilts the flakes in a preferred direction and is suitable for adaptation to a high-speed printing process. Three 2" by 1.5" NdFeB 40MOe magnets 164, 164' are tilted 10° relative to the substrate 29 and printed images 166. Flakes 26 follow magnetic lines and re-orient themselves. The magnets have the same alignment similar to the alignment shown in FIG. 9D. Two of the magnets 164 have their north poles up and the magnet 164' between them has its south pole facing the substrate 29. The printed images 166 should be placed above the central axis of the magnet to take advantage of the tilted magnetic field lines generated by the tilted magnets. Such arrangement produces uniform tilt of the flake on an area that is larger than for the magnetic assemblies described in reference to FIGS. 9A-9E.

Magnetic lines in the field are not parallel. The difference is minor in the near order and becomes larger with increase of a distance between the lines. It means, that on a large printed image, placed in magnetic field, all flakes would have different tilt resulting in a non-consistent image appearance. The inconsistency can be reduced by deflecting of magnetic lines toward the center of the magnet to keep them more parallel. It is possible to do with small auxiliary magnets.

Figure 10B:
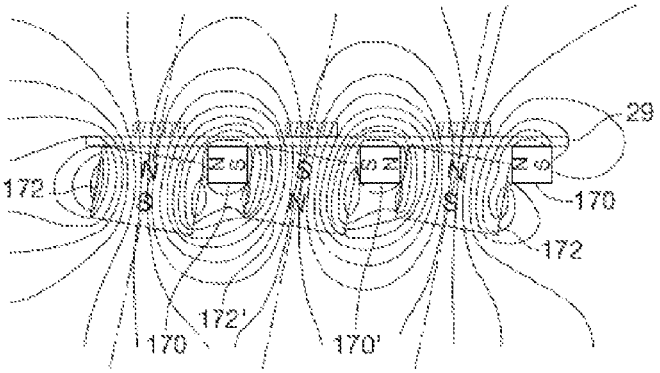
FIG. 10B is a simplified side view of an apparatus for printing illusive images that includes auxiliary magnets according to another embodiment of the present invention.

FIG. 10B is a simplified side view of an apparatus 168 according to an embodiment of the present invention including auxiliary magnets 170, 170'. The tilted primary magnets 172, 172' are arranged similar to the magnets shown in FIG. 10A, with alternating magnets presenting alternating poles (north-south-north) next to the substrate 29. The smaller auxiliary magnets are located beneath the substrate and between the larger primary magnets. The auxiliary magnets are arranged so that the north pole of an auxiliary magnet faces the north pole of a primary magnet, and its south pole faces the south pole of a primary magnet. In such an arrangement, two fields (north-north, south-south) oppose each other and magnetic lines become deflected toward the center of the primary magnets.

Figure 10C:
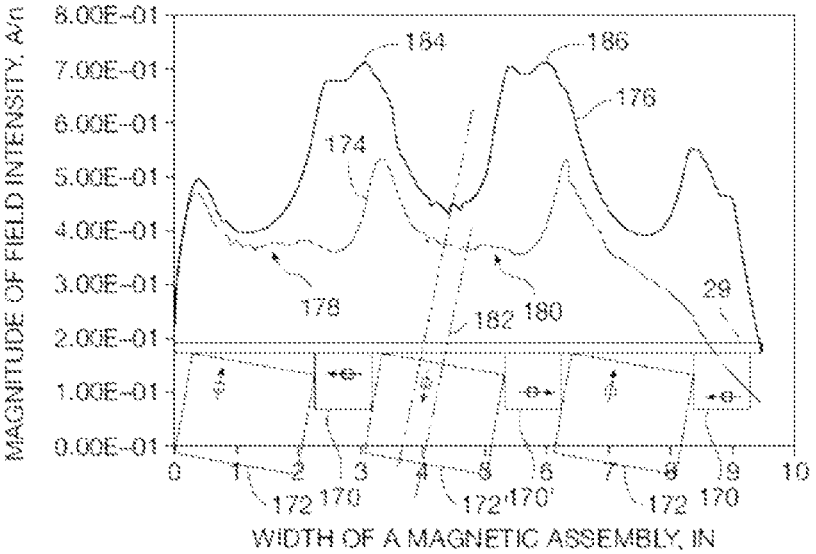
FIG. 10C is a simplified plot illustrating the magnetic field intensity for the apparatus of FIGS. 10A and 10B.

FIG. 10C is a simplified plot showing the calculated field intensity for the magnetic assemblies shown in FIGS. 10A and 10B, represented by curves 174 and 176, respectively. The substrate 29, primary magnets 172, 172'and auxiliary magnets 170, 170' are shown to illustrate how the plots relate to the assembly dimensions, although the auxiliary magnets are only relevant to the plot of the second curve 176. The first curve 174 shows how the magnitude of field intensity of the assembly in FIG. 10A changes in the direction from one edge of the substrate to another. The curve has two minima 178, 180 corresponding to the center of the primary magnets 172, 172'. A central axis 182 of the center magnet 172' shows where the center of the magnet and the plot of field intensity coincide.

Inclusion of the auxiliary magnets 170, 170' in the assembly shifts magnitude of field intensity to the left. The second curve 176 shows magnitude of field intensity of an assembly according to FIG. 10B. The maxima 184, 186 on the curve are shifted to the left relative to the first curve 174 associated with FIG. 10A. This shows that opposing fields on the auxiliary magnets deflect the fields of the primary magnets.

Figure 11A:
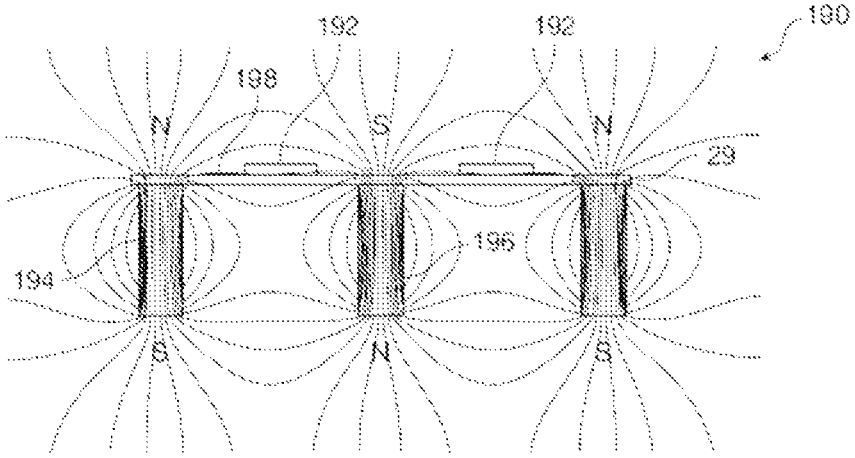
FIG. 11A is a simplified side view of an apparatus for aligning magnetic pigment flakes to the plane of the substrate after printing.

FIG. 11A is a simplified side view of an apparatus 190 for aligning magnetic pigment flakes in printed fields 192 in the plane of a substrate after printing. Magnets 194, 196 are arranged to produce magnetic field lines 198 essentially parallel to the surface of the substrate 29. In some printing processes using pigment flakes, the flakes align essentially parallel to the substrate when applied (printed), but are "pulled" out of plane when the printing screen is lifted, for example. This disorganization of the flakes tends to reduce the visual effect of the print, such as a reduction in chroma.

In one instance, magnetic color-shifting pigment flakes were applied to a paper card using a conventional silkscreen process. The same ink was applied to another paper card, but before the ink carrier dried, a magnet was used to re-orient the flakes in the plane of the card. The difference in visual appearance, such as the intensity of the colors, was very dramatic. Measurements indicated that a 10% improvement in chroma had been attained. This level of improvement is very significant, and it is believed that it would be very difficult to achieve such an improvement through modifications of the pigment flake production techniques, such as changes to the substrate and thin film layers of the flake. It is believed that even greater improvement in chroma is possible, and that a 40% improvement might be obtained when magnetic re-alignment techniques are applied to images formed using an Intaglio printing process.

Figure 11B:
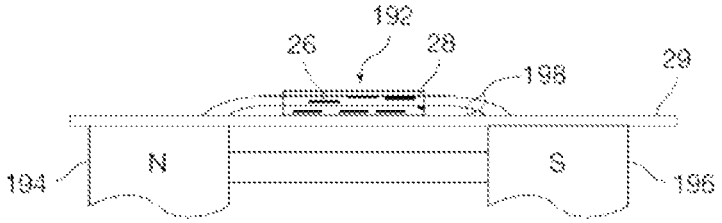
FIG. 11B is a simplified side view of a portion of an apparatus for enhancing the visual quality of an image printed with magnetically alignable flakes.

FIG. 11B is a simplified side view of a portion of an apparatus for enhancing the visual quality of an image printed with magnetically alignable flakes according to another embodiment of the present invention. Magnets 194, 196 create magnetic field lines 198 that are essentially parallel to the substrate 29, which causes the magnetic pigment flakes 26 in the fluid carrier 28 to flatten out. The magnets can be spaced some distance apart to provide the desired magnetic field, and the apparatus can be adapted to an in-line printing process.

FIG. 12A shows a magnetic roller 232 that can be used in the apparatus 500; it has been described in U.S. Pat. No. 7,047,883. Magnetic assemblies 234, 236, 238, 240, 241 are attached to the roller with screws 242, which allow the magnetic assemblies to be changed without removing the roller from the printer. The magnetic assemblies could be configured to produce flip-flop 234, 236 or rolling bar 238 images, or could be patterned magnetic material 240, 241 that produces a patterned image on the printed substrate, or other selected magnetic configuration. The magnetic structures on the roller are aligned to the sheet or roll to provide the desired magnetic field pattern to fields printed on the substrate with magnetic pigment flakes. The illustrated patterns represent flat patterns that follow the curve of the circumference of the roller.

It is advantageous in applications to have the outer surface 244 of the roller 232 sufficiently even or smooth, otherwise it can potentially deform or even damage the substrate 212. For these applications, it is preferred that the outer surface 244 does not have any protruding portions, resulting in a substantially even and uniform contact of the roller with the substrate across the outer surface of the roller.

Figure 12B:
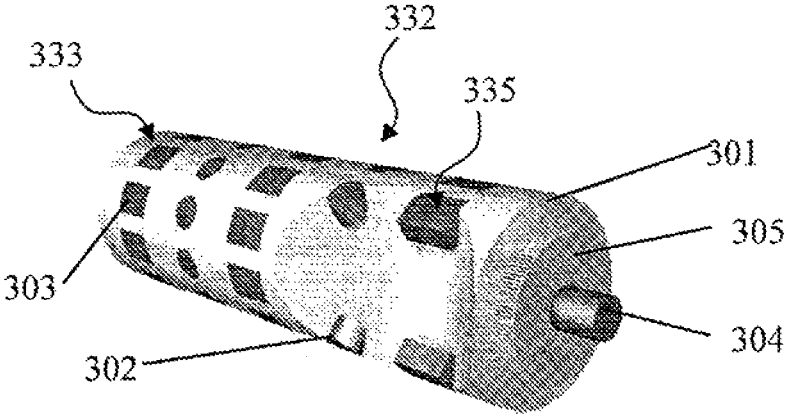
FIG. 12B is a simplified perspective view of a magnetic roller incorporating embedded permanent magnets.

FIG. 12B schematically illustrates a magnetic roller 332 for orienting magnetic flakes according to an embodiment of the present invention. The magnetic roller 332 has a solid cylindrical body 301, hereinafter also referred to as a cylindrical member or drum, of preferably non-magnetic material, wherein a plurality of cavities is formed, i.e. milled out of the body 301 from its outer surface 333. Permanent magnets of pre-determined shapes, as required for forming the desired flake patterns, e.g. magnets 302 and 303, are inserted in the cavities as shown by dark-shaded areas of the roller 332, forming magnetic portions of the roller 332. In FIG. 12B, the cavities are shown as dark-shaded areas with the magnets inserted therein, e.g. the magnets 302, 303 and 335, with a cut-out in a portion of the body 301 shown for the benefit of the viewer to illustrate the positions of the magnets, e.g. the cylindrical magnet 302 and the prism-shaped magnet 335, within the drum 301. The cavities have the pre-determined shape and dimensions of the permanent magnets, and the magnets are statically and immovably kept therein. In some embodiments, the magnets 302, 303 can be fixed in their position by glue, screws, brackets, etc, or can be press-fitted and kept in their positions by traction. The permanent magnets 302, 303, although shown by way of illustration having cylindrical and rectangular shapes, have at least their outer surfaces, e.g. as indicated by an arrow 335, shaped for creating magnetic fields of predetermined configurations, so as to orient the magnetic flakes in desired 3D patterns when the roller is used in the printing apparatus 200. In the shown embodiment, the roller 332 is mounted on an axel 304 with bearings that are not shown in the figure, and a gear wheel 305 fixedly attached to the roller is further provided for rotating the roller 332 about the axel 304 during the printing process.

In one embodiment, the magnets 302, 303 are positioned flush with the outer surface 333 of the body 301, so that the outer surface of the roller 332 with the magnets 303, 302 therein is substantially even for providing substantially uniform contact with the substrate 212 across the outer surface of the roller 332 during the linear printing process. The term "contact" is used herein to mean either direct or indirect contact between two surfaces, i.e. via an intermediate sheet or plate. In another embodiment, at least one of the magnets 302, 303 is recessed relative to the outer surface 333 of the drum 301, and the recess is filled with a non-magnetic filler, e.g. an epoxy, tin, brass, or other, to make the outer surface of the roller substantially even as described hereinabove. The ability to have different magnets at different distances from the ink layer is advantageous for creating different types of optical effects provided by the respective magnetic flake arrangements. Generally, for forming flake arrangements providing sharp image transitions, as for example for forming a flip-flop image, the ink-magnet distance should be minimized. However, for forming images or optical effects wherein transitions in the image should be smeared, e.g. for providing an illusion of depth as in a rolling bar image, the magnets are preferably positioned at a larger distance from the ink layer, for example between 0.125" to 0.75' for a rolling bar image depending on particular requirements of the graphics. The rolling bar and flip-flop images, and magnet arrangements that can be used for their fabrication are described, for example, in U.S. Pat. No. 7,047,883.

We claim:

1. An apparatus for aligning magnetic flakes in a carrier printed on a substrate, the apparatus comprising: a rotatable roller comprising a magnet for creating a magnetic field emanating from an outer surface of the roller; a movable belt bending about the rotatable roller, for supporting the substrate and for moving the substrate proximate to the magnet along an arc on the outer surface of the rotatable roller, wherein the arc comprises first and second arc segments; and, a solidifying means for at least partially solidifying the carrier, disposed along the second arc segment, wherein no solidifying means is disposed along the first arc segment, so as to align the magnetic flakes by the magnetic field, when the magnetic flakes move on the support within the first arc segment, and to secure the magnetic flakes in the carrier using the solidifying means while alignment of the magnetic flakes is maintained by the magnetic field, when the carrier with the magnetic flakes move on the support within the second arc segment.

2. An apparatus for aligning magnetic flakes dispersed in a carrier, comprising:

a support for supporting a substrate movable along a support path;

a dispenser for coating the substrate with the carrier having the magnetic flakes dispersed therein;

a magnet assembly disposed along a first path segment of the support path, wherein the first path segment comprises second and third path segments, for aligning the magnetic flakes with a magnetic field; and, a solidifying means disposed along the third path segment, for at least partially solidifying the carrier and securing the magnetic flakes in the carrier while alignment of the magnetic flakes is maintained by the magnetic field when the carrier with the magnetic flakes move within the third path segment; wherein the second path segment is absent of solidifying means;

wherein the support is movable along a curved support path, the support follows a surface of the magnet assembly, and the magnet assembly is a rotary magnet assembly; and wherein the support comprises a belt which bends about the rotary magnet assembly.

3. An apparatus as defined in claim 2, wherein the dispenser provides the carrier to the substrate supported by the support.

4. An apparatus as defined in claim 3, wherein the dispenser comprises a printer.

5. An apparatus as defined in claim 2, wherein the dispenser provides the substrate coated with the carrier to the support.

6. An apparatus as defined in claim 2, wherein the solidifying means comprises a UV source.

7. An apparatus as defined in claim 2, wherein the support is movable along the magnet assembly perpendicular to force lines of the magnetic field provided by the assembly.

8. An apparatus as defined in claim 2, wherein the magnet assembly comprises an electromagnet.

9. An apparatus as defined in claim 2, wherein the solidifying means comprises a heater.

10. An apparatus as defined in 2, further comprising a screen along at least a portion of the second path segment so as to ensure the absence of an effect from the solidifying means onto the carrier, when the carrier with the magnetic flakes move on the support within the second path segment.

11. An apparatus as defined in claim 2, wherein the magnet assembly is disposed under the belt and the solidifying means is disposed above the belt.

12. An apparatus as defined in claim 2, wherein the magnetic assembly comprises a roller with magnetic inserts.

* * * * *